US011603571B2

(12) United States Patent
Yamazaki et al.

(10) Patent No.: US 11,603,571 B2
(45) Date of Patent: Mar. 14, 2023

(54) HIGH-STRENGTH HOT-ROLLED STEEL SHEET AND METHOD FOR PRODUCING THE SAME

(71) Applicant: JFE Steel Corporation, Tokyo (JP)

(72) Inventors: Kazuhiko Yamazaki, Tokyo (JP); Shunsuke Toyoda, Tokyo (JP); Noriaki Moriyasu, Tokyo (JP); Sumio Kaiho, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 136 days.

(21) Appl. No.: 16/485,978

(22) PCT Filed: Feb. 6, 2018

(86) PCT No.: PCT/JP2018/004043
§ 371 (c)(1),
(2) Date: Aug. 14, 2019

(87) PCT Pub. No.: WO2018/150955
PCT Pub. Date: Aug. 23, 2018

(65) Prior Publication Data

US 2020/0063227 A1 Feb. 27, 2020

(30) Foreign Application Priority Data

Feb. 17, 2017 (JP) ..... JP2017-027510

(51) Int. Cl.
*C22C 38/02* (2006.01)
*C21D 8/02* (2006.01)
*C22C 38/04* (2006.01)
*C22C 38/06* (2006.01)

(52) U.S. Cl.
CPC ..... *C21D 8/0226* (2013.01); *C21D 8/0205* (2013.01); *C22C 38/02* (2013.01); *C22C 38/04* (2013.01); *C22C 38/06* (2013.01)

(58) Field of Classification Search
CPC .... C21D 2211/002; C21D 2211/11008; C21D 8/0226; C21D 8/0263; C21D 9/46; C21D 38/002
USPC ..... 148/337
See application file for complete search history.

(56) References Cited

U.S. PATENT DOCUMENTS

| | | | | |
|---|---|---|---|---|
| 10,087,499 | B2 | 10/2018 | Shuto et al. | |
| 10,400,316 | B2 * | 9/2019 | Nakajima | C22C 38/14 |
| 2003/0217795 | A1 | 11/2003 | Asahi et al. | |
| 2004/0231393 | A1 * | 11/2004 | Mega | C22C 38/12 72/365.2 |
| 2013/0319582 | A1 | 12/2013 | Yokoi et al. | |
| 2015/0376730 | A1 | 12/2015 | Shuto et al. | |
| 2016/0076124 | A1 | 3/2016 | Yamazaki et al. | |
| 2017/0009316 | A1 | 1/2017 | Yamazake et al. | |
| 2018/0037967 | A1 | 2/2018 | Sugiura et al. | |
| 2021/0140007 | A1 * | 5/2021 | Yamazaki | C21D 8/005 |

FOREIGN PATENT DOCUMENTS

| | | | |
|---|---|---|---|
| CN | 102549186 | A | 7/2012 |
| CN | 103917682 | A | 7/2014 |
| CN | 104040009 | A | 9/2014 |
| CN | 105112815 | A1 | 12/2015 |
| CN | 105121684 | A | 12/2015 |
| CN | 105143486 | A | 12/2015 |
| EP | 2759615 | A1 | 7/2014 |
| EP | 2801637 | A1 | 11/2014 |
| EP | 2949772 | A1 | 12/2015 |
| EP | 2987886 | A1 | 2/2016 |
| EP | 3296415 | A1 | 3/2018 |
| JP | 04317419 | A | 11/1992 |
| JP | 09137249 | A | 5/1997 |
| JP | 2002180190 | A | 6/2002 |
| JP | 2009019265 | A | 1/2009 |
| JP | 2009084637 | A | 4/2009 |
| JP | 4466352 | B2 | 5/2010 |
| JP | 2013227603 | A | 11/2013 |
| JP | 5621942 | B2 | 11/2014 |
| JP | 2015190015 | A | 11/2015 |
| WO | 2014171063 | A1 | 10/2014 |

(Continued)

OTHER PUBLICATIONS

Extended European Search Report for European Application No. 18753529.9. dated Oct. 29, 2019, 10 pages.
International Search Report and Written Opinion for International Application No. PCT/JP2018/004043, dated May 15, 2018—6 pages.
Chinese Office Action with Search Report for Chinese Application No. 201880012139.4, dated Dec. 1, 2020, 11 pages.

* cited by examiner

*Primary Examiner* — Jie Yang
(74) *Attorney, Agent, or Firm* — RatnerPrestia

(57) ABSTRACT

There are provided a high-strength hot-rolled steel sheet having a tensile strength of 980 MPa or more and a production method therefor. The high-strength hot-rolled steel sheet has a predetermined component composition and a microstructure containing 75.0% or more by area and less than 97.0% by area of a primary phase composed of an upper bainite phase, the primary phase having an average grain size of 12.0 μm or less, and more than 3.0% by area and 25.0% or less by area of a secondary phase that is a structure composed of one or two of a lower bainite phase and/or a tempered martensite phase, and a martensite phase, in which the number density of grains of the secondary phase having an equivalent circular diameter of 0.5 μm or more is 150,000 grains/mm$^2$ or less, and the steel sheet has an arithmetic mean surface roughness of 2.00 μm or less.

11 Claims, No Drawings

(56) References Cited

FOREIGN PATENT DOCUMENTS

| | | | |
|---|---|---|---|
| WO | 2014188966 | A1 | 11/2014 |
| WO | 2016135898 | A1 | 9/2016 |
| WO | 2017017933 | A1 | 2/2017 |

HIGH-STRENGTH HOT-ROLLED STEEL SHEET AND METHOD FOR PRODUCING THE SAME

CROSS REFERENCE TO RELATED APPLICATIONS

This is the U.S. National Phase application of PCT/JP2018/004043, filed Feb. 6, 2018, which claims priority to Japanese Patent Application No. 2017-027510, filed Feb. 17, 2017, the disclosures of these applications being incorporated herein by reference in their entireties for all purposes.

FIELD OF THE INVENTION

The present invention relates to a high-strength hot-rolled steel sheet having good press formability, good low-temperature toughness, and a tensile strength, TS, of 980 MPa or more and thus being suitable for automotive structural members, automotive frame members, automotive undercarriage members such as suspensions, and truck frame members, and relates also to a method for producing the high-strength hot-rolled steel sheet.

BACKGROUND OF THE INVENTION

In recent years, automotive emission regulations have been tightened from the viewpoint of global environmental protection. Thus, an improvement in the fuel efficiency of automobiles is an important issue. Materials used are required to have higher strength and a smaller thickness. To address this, high-strength hot-rolled steel sheets are actively used as materials of automotive components. Such high-strength hot-rolled steel sheets are used for automotive undercarriage members, truck frame members, and so forth as well as automotive structural members and automotive frame members.

As described above, a demand for a high-strength hot-rolled steel sheet having predetermined strength is increasing year by year as a material for automotive components. In particular, a high-strength hot-rolled steel sheet having a tensile strength, TS, of 980 MPa or more is expected as a material that can significantly improve the fuel efficiency of automobiles.

With an increase in the strength of steel sheets, however, material properties such as low-temperature toughness and press formability are typically degraded. In particular, a steel sheet used for automotive undercarriage members is required to have all of stretch formability, stretch-flangeability, bending formability, fatigue properties, impact resistance, corrosion resistance, and so forth. It is significantly important to ensure these material properties and high strength in a high level in a well-balanced manner. Automotive undercarriage members are mainly formed by press forming. Thus, the material is required to have stretch formability, stretch-flangeability, and bending formability in a well-balanced manner.

Additionally, automotive members are required to be less likely to be broken even if automotive members receive impacts due to collisions after automotive members are attached to automobiles as members. In particular, in order to ensure impact resistance in cold regions, it is also necessary to improve low-temperature toughness.

Here, stretch formability, stretch-flangeability, and bending formability are collectively referred to as "press formability". The stretch formability is measured by, for example, a tensile test according to JIS Z 2241. The stretch-flangeability is measured by, for example, a hole expanding test according to The Japan Iron and Steel Federation Standard JFST 1001. The bending formability is measured by, for example, a bending test according to JIS Z 2248. The low-temperature toughness is measured by, for example, the Charpy impact test according to JIS Z 2242.

Hitherto, in order to increase the strength of steel sheets without degrading these material properties, various studies have been made. For example, Patent Literature 1 discloses a hot-rolled steel sheet having a composition containing, by mass, C: 0.01% or more and 0.10% or less, Si: 2.0% or less, Mn: 0.5% or more and 2.5% or less, and 0.5% or less in total of one or two or more of V: 0.01% or more and 0.30% or less, Nb: 0.01% or more and 0.30% or less, Ti: 0.01% or more and 0.30% or less, Mo: 0.01% or more and 0.30% or less, Zr: 0.01% or more and 0.30% or less, and W: 0.01% or more and 0.30% or less, the hot-rolled steel sheet having a microstructure that has a bainite fraction of 80% or more, in which the average particle size r (nm) of precipitates satisfies $r \geq 207/\{27.4X(V)+23.5X(Nb)+31.4X(Ti)+17.6X(Mo)+25.5X(Zr)+23.5X(W)\}$ (where X(M) is the average atomic weight of an element contained in the precipitates (where M is V, Nb, Ti, Mo, Zr, or W), and X(M)=(percentage by mass of M/atomic weight of M)/(V/51+Nb/93+Ti/48+Mo/96+Zr/91+W/184)), and the average grain size r and the precipitate fraction f satisfy $r/f \leq 12{,}000$.

Patent Literature 1 also discloses a method for producing a hot-rolled steel sheet having the microstructure described above by heating the steel having the composition described above, performing hot rolling at a finish rolling temperature of 800° C. or higher and 1,050° C. or lower, performing rapid cooling at 20° C./s or more to a temperature range (range of 500° C. to 600° C.) at which bainite transformation and precipitation occur simultaneously, performing coiling at 500° C. to 550° C., and performing holding at a cooling rate of 5° C./h or less (including 0° C./h) for 20 h or more. In the technique described in Patent Literature 1, the steel sheet is mainly composed of bainite, the bainite is subjected to precipitation strengthening using carbides of, for example, V, Ti, and Nb, and the size of precipitates is appropriately controlled (moderately coarsened). Thereby, a high-strength hot-rolled steel sheet having good stretch-flangeability is obtained.

For example, Patent Literature 2 discloses a high-strength thin steel sheet having a tensile strength of 980 N/mm$^2$ or more, good hole expansion formability, and good ductility, and containing, by mass, C: 0.01% to 0.20%, Si: 1.5% or less, Al: 1.5% or less, Mn: 0.5% to 3.5%, P: 0.2% or less, S: 0.0005% to 0.009%, N: 0.009% or less, Mg: 0.0006% to 0.01%, 0: 0.005% or less, and one or two of Ti: 0.01% to 0.20% and Nb: 0.01% to 0.10%, the balance being iron and incidental impurities, the high-strength thin steel sheet having a steel microstructure that satisfies all formulae (1) to (7) and that is mainly composed of a bainite phase, $$[Mg\ \%] \geq ([0\%]/16 \times 0.8) \times 24 \ldots \quad (1)$$

$$[S\ \%] \leq ([Mg\ \%]/24 - [0\%]/16 \times 0.8 + 0.00012) \times 32 \ldots \quad (2)$$

$$[S\ \%] \leq 0.0075/[Mn\ \%] \ldots \quad (3)$$

$$[Si\ \%] + 2.2 \times [Al\ \%] \geq 0.35 \ldots \quad (4)$$

$$0.9 \leq 48/12 \times [C\ \%]/[Ti\ \%] < 1.7 \ldots \quad (5)$$

$$50{,}227 \times [C\ \%] - 4{,}479 \times [Mn\ \%] > -9{,}860 \ldots \quad (6)$$

$$811 \times [C\ \%] + 135 \times [Mn\ \%] + 602 \times [Ti\ \%] + 794 \times [Nb\ \%] > 465 \ldots \quad (7)$$

Patent Literature 3 discloses a hot-rolled steel sheet having a composition that contains, by mass, C: 0.01% to 0.08%, Si: 0.30% to 1.50%, Mn: 0.50% to 2.50%, P≤0.03%, S≤0.005%, and one or two of Ti: 0.01% to 0.20% and Nb: 0.01% to 0.04%, the hot-rolled steel sheet having a ferrite-bainite dual-phase microstructure that contains 80% or more ferrite with a grain size of 2 μm or more. In the technique described in Patent Literature 3, the use of the ferrite-bainite dual-phase microstructure and a ferrite grain size of 2 μm or more enable an improvement in ductility without degrading the hole expansion formability. Thereby, a high-strength hot-rolled steel sheet having a strength of 690 N/mm$^2$ or more, good hole expansion formability, and good ductility is obtained.

Patent Literature 4 discloses a high-strength hot-rolled steel sheet having a controlled texture, good stretch-flangeability, and good low-temperature toughness, the high-strength hot-rolled steel sheet having a microstructure that has a total area percentage of tempered martensite, martensite, and lower bainite of more than 85% and an average grain size of 12.0 μm or less.

PATENT LITERATURE

PTL 1: Japanese Unexamined Patent Application Publication No. 2009-84637

PTL 2: Japanese Patent No. 4317419

PTL 3: Japanese Unexamined Patent Application Publication No. 2002-180190

PTL 4: Japanese Patent No. 5621942

SUMMARY OF THE INVENTION

However, in the techniques described in Patent Literature 1 to 3, mention is particularly made only of stretch formability and stretch-flangeability in press formability, and no mention is made of low-temperature toughness. When they are used in cold regions, brittle fracture may occur.

In the technique described in Patent Literature 4, mention is made of stretch-flangeability and low-temperature toughness. However, no mention is made of stretch formability or bending formability. When the technique is applied to members such as automotive undercarriage members required to have high press formability, forming defects may be caused.

In the related art, a technique for obtaining a hot-rolled steel sheet having good press formability and good low-temperature toughness while maintaining high strength, i.e., a tensile strength, TS, of 980 MPa or more, is not established, as described above.

Aspects of the present invention aim to provide a high-strength hot-rolled steel sheet that solves the foregoing problems of the related art and that has good press formability and good low-temperature toughness while maintaining high strength, i.e., a tensile strength, TS, of 980 MPa or more, and a method for producing the high-strength hot-rolled steel sheet.

To solve the foregoing problems, the inventors have conducted intensive studies to improve the low-temperature toughness and the press formability of a hot-rolled steel sheet while maintaining high strength, i.e., a tensile strength, TS, of 980 MPa or more, and have found the following: High stretch formability is obtained by the use of a microstructure having a primary phase composed of an upper bainite phase and a secondary phase that is a structure composed of one or two of a lower bainite phase and/or a tempered martensite phase, and a martensite phase. Good toughness is obtained by controlling the grain size of the primary phase and the area percentage of grains of the secondary phase. High stretch-flangeability is obtained by controlling the number density of the secondary phase having an equivalent circular diameter of 0.5 μm or more. The control of the arithmetic mean surface roughness (Ra) of the hot-rolled steel sheet results in high bendability and can maintain high strength, i.e., a tensile strength, TS, of 980 MPa or more.

The term "upper bainite phase" used here refers to a structure of lath-like bainitic ferrite, the structure containing an Fe-based carbide and/or a retained austenite phase between grains of the bainitic ferrite (however, the term also includes the case where an Fe-based carbide and/or a retained austenite phase is not present between the grains of the bainitic ferrite). Unlike polygonal ferrite, bainitic ferrite has a lath shape. Thus, both can be distinguished from each other with a scanning electron microscope (SEM). The term "lower bainite phase and/or tempered martensite phase" used here refers to a microstructure containing an Fe-based carbide in the lath-like bainitic ferrite (however, the term also includes the case where the Fe-based carbide is also present between grains of the bainitic ferrite). Although the lower bainite and the tempered martensite can be distinguished from each other by observing the orientation and the crystal structure of the Fe-based carbide in the lath with a transmission electron microscope (TEM), because they have substantially the same properties, they are not distinguished from each other in accordance with aspects of the present invention. Additionally, they have a higher dislocation density than upper bainite and thus can be distinguished with a SEM or transmission electron microscope (TEM). A fresh martensite phase (hereinafter, referred to as a "martensite phase") is a microstructure that does not contain an Fe-based carbide, compared with the lower bainite phase and/or the tempered martensite phase. Additionally, the martensite phase appears brighter in a SEM image than the upper bainite phase, the lower bainite phase and/or tempered martensite phase, and polygonal ferrite and thus can be distinguished with a SEM.

Typically, the presence of a microstructure having the same hardness and the same ductility in a hot-rolled steel sheet in the form of a single phase increases the yield ratio (YR), which is the ratio of yield stress (YS) to tensile strength (TS). When a steel sheet having a high yield ratio is subjected to stretch forming, forming defects such as necking and fractures are caused at a strain-concentrating portion because the steel sheet has a low ability to disperse strain. A hot-rolled steel sheet according to aspects of the present invention has mixed structures different in terms of hardness and ductility and thus has a low yield ratio, thereby improving the stretch formability of the material.

Typically, when a soft ferrite phase or an upper bainite phase is present as a primary phase and when a lower bainite phase and/or a tempered martensite phase, and a martensite phase, which serve as a hard secondary-phase structure, are present in the primary phase, voids are formed at boundaries between the primary phase and the secondary phase during a hole expanding test. The connection between the formed voids leads to a crack penetrating through the sheet in the thickness direction at an early stage of the hole expanding test, thereby deteriorating the stretch-flangeability. It is known that an increase in the area percentage of a secondary phase deteriorates the low-temperature toughness of a hot-rolled steel sheet. The inventors have conducted further studies and have found the following: In the case where an upper bainite phase serves as a primary phase and where a structure containing one or two of an lower bainite phase and/or a tempered martensite phase, and a martensite phase serves as a secondary phase, voids are not easily formed at the boundaries between the primary phase and the secondary phase during a hole expanding test by increasing the percentage of grains of the secondary phase having an equivalent circular diameter of less than 0.5 μm. The formed voids are less likely to be connected to each other by controlling the number density of the grains of the secondary phase having an equivalent circular diameter of 0.5 μm or more. Thereby, a hot-rolled steel sheet having high stretch formability and a tensile strength, TS, of 980 MPa or more can be ensured without significantly deteriorating the stretch-flangeability. The inventors have also found that good low-temperature toughness is obtained by controlling the area-average grain size (average grain size) of the primary phase and the area percentage of the secondary phase. Furthermore, the inventors have found that good bondability can be ensured by controlling the microstructure of a hot-rolled steel sheet and then controlling the arithmetic mean surface roughness (Ra) of the hot-rolled steel sheet.

The inventors have conducted further studies on the basis of the findings described above and have examined the following points required to improve the press formability while maintaining high strength, i.e., a tensile strength, TS, of 980 MPa or more: the composition, the area percentage and the average grain size of the upper bainite phase, the area percentage of the secondary phase, which is a structure composed of one or two of the lower bainite phase and/or the tempered martensite phase, and the martensite phase, the number density of grains of the secondary phase having an equivalent circular diameter of 0.5 μm or more, and the arithmetic mean surface roughness (Ra) of the hot-rolled steel sheet.

The inventors have found that the following are important: A hot-rolled steel sheet has a composition containing, by mass, C: 0.04% or more and 0.15% or less, Si: 0.4% or more and 2.0% or less, Mn: 1.0% or more and 3.0% or less, P: 0.100% or less (including 0%), S: 0.0100% or less (including 0%), Al: 0.01% or more and 2.00% or less, N: 0.010% or less (including 0%), Ti: 0.03% or more and 0.15% or less, B: 0.0005% or more and 0.0050% or less, and one or two or more of Cr: 0.10% or more and 2.50% or less, Mo: 0.05% or more and 0.50% or less, Nb: 0.005% or more and 0.060% or less, and V: 0.05% or more and 0.50% or less, the balance being Fe and incidental impurities. The hot-rolled steel sheet has a microstructure containing 75.0% or more by area percentage and less than 97.0% by area percentage of a primary phase composed of an upper bainite phase, the primary phase having an average grain size of 12.0 μm or less, and more than 3.0% by area percentage and 25.0% or less by area percentage of a secondary phase that is a structure composed of one or two of a lower bainite phase and/or a tempered martensite and a martensite phase, the number density of grains of the secondary phase having an equivalent circular diameter of 0.5 μm or more being 150,000 or less grains/mm$^2$, the steel sheet having an arithmetic mean surface roughness (Ra) of 2.00 μm or less.

Aspects of the present invention have been accomplished by conducting further studies on the basis of the findings, and will be described below.

[1] A high-strength hot-rolled steel sheet having a tensile strength, TS, of 980 MPa or more has a component composition containing, by mass: C: 0.04% or more and 0.15% or less, Si: 0.4% or more and 2.0% or less, Mn: 1.0% or more and 3.0% or less, P: 0.100% or less (including 0%), S: 0.0100% or less (including 0%), Al: 0.01% or more and 2.00% or less, N: 0.010% or less (including 0%), Ti: 0.03% or more and 0.15% or less, B: 0.0005% or more and 0.0050% or less, and one or two or more selected from Cr: 0.10% or more and 2.50% or less, Mo: 0.05% or more and 0.50% or less, Nb: 0.005% or more and 0.060% or less, and V: 0.05% or more and 0.50% or less, the balance being Fe and incidental impurities; and a microstructure containing 75.0% or more by area percentage and less than 97.0% by area percentage of a primary phase composed of an upper bainite phase, the primary phase having an average grain size of 12.0 μm or less, and more than 3.0% by area percentage and 25.0% or less by area percentage of a secondary phase that is a structure composed of one or two of a lower bainite phase and/or a tempered martensite phase, and a martensite phase, in which the number density of grains of the secondary phase having an equivalent circular diameter of 0.5 μm or more is 150,000 grains/mm$^2$ or less, and the steel sheet has an arithmetic mean surface roughness (Ra) of 2.00 μm or less.

[2] In the high-strength hot-rolled steel sheet described in [1], the component composition further contains, by mass, one or two selected from Cu: 0.01% or more and 0.50% or less and Ni: 0.01% or more and 0.50% or less.

[3] In the high-strength hot-rolled steel sheet described in [1] or [2], the component composition further contains, by mass, Sb: 0.0002% or more and 0.0200% or less.

[4] In the high-strength hot-rolled steel sheet described in any of [1] to [3], the component composition further contains, by mass, one or two or more selected from Ca: 0.0002% or more and 0.0100% or less, Mg: 0.0002% or more and 0.0100% or less, and REM: 0.0002% or more and 0.0100% or less.

[5] The high-strength hot-rolled steel sheet described in any of [1] to [4] further includes a coated layer on a surface of the steel sheet.

[6] A method for producing the high-strength hot-rolled steel sheet having a tensile strength, TS, of 980 MPa or more described in any of [1] to [4] includes:

heating a steel to 1,150° C. or higher;

then performing hot rolling including, after performing rough rolling, performing descaling with high-pressure water at an impact pressure of 3.0 MPa or more before finish rolling, and performing the finish rolling, wherein letting an RC temperature be defined by formula (1), the total rolling reduction is 50% or more at the RC temperature or higher and then 80% or less at lower than the RC temperature, and the finishing temperature is (RC−100° C.) or higher and (RC+100° C.) or lower;

then starting cooling within 2.0 s after completion of the finish rolling, in which letting an Ms temperature be defined by formula (2), the cooling is performed to a cooling stop temperature of higher than the Ms temperature and 600° C. or lower at an average cooling rate of 30° C./s or more;

performing coiling at the cooling stop temperature; and then cooling a steel sheet to (Ms−100° C.) at an average cooling rate of 0.20° C./min or more, $$RC\ (^\circ C.)=850+100\times C+100\times N+10\times Mn+700\times Ti+5{,}000\times B+10\times Cr+50\times Mo+2{,}000\times Nb+150\times V \quad \text{formula (1)}$$

$$Ms\ (^\circ C.)=561-474\times C-33\times Mn-17\times Ni-21\times Mo \quad \text{formula (2)}$$

where each element symbol in formulae (1) and (2) indicates the element content (% by mass) of the steel, and when an element is not contained, the element symbol in the formula is calculated as 0.

[7] The method for producing the high-strength hot-rolled steel sheet described in [6] further includes subjecting a surface of the steel sheet to coating treatment.

In accordance with aspects of the present invention, the "high-strength hot-rolled steel sheet" indicates a steel sheet having a tensile strength, TS, of 980 MPa or more and includes a steel sheet obtained by subjecting a hot-rolled steel sheet to surface treatment such as hot-dip coating treatment, hot-dip alloying treatment, or electroplating treatment. The "high-strength hot-rolled steel sheet" also includes a steel sheet including a coating film formed by, for example, chemical conversion treatment on a hot-rolled steel sheet or a surface-treated steel sheet. In accordance with aspects of the present invention, "good press formability" indicates that the value (YR %=YP/TS×100) of the yield strength YP with respect to the tensile strength, TS, is 92.0% or less in terms of stretch formability, the value of the hole expansion ratio λ is 50% or more in terms of stretch-flangeability, and the value of the limit bending radius (R/t) with respect to the sheet thickness is 1.20 or less in terms of bending workability. Additionally, "good low-temperature toughness" indicates that a ductile-to-brittle fracture transition temperature (vTrs) is −40° C. or lower. In accordance with aspects of the present invention, the "primary phase" indicates that the area percentage thereof is 75.0% or more.

According to aspects of the present invention, the high-strength hot-rolled steel sheet having a tensile strength, TS, of 980 MPa or more, good press formability, and good low-temperature toughness is provided. Additionally, the high-strength hot-rolled steel sheet can be stably produced. When the high-strength hot-rolled steel sheet according to aspects of the present invention is used for, for example, automotive undercarriage members, automotive structural members, automotive frame members, and truck frame members, the weight of automotive bodies is reduced while automotive safety is ensured; hence, it can contribute to a reduction in environmental load, providing industrially marked effects.

DETAILED DESCRIPTION OF EMBODIMENTS OF THE INVENTION

Embodiments of the present invention will be specifically described below.

A high-strength hot-rolled steel sheet according to aspects of the present invention has a component composition containing, by mass, C: 0.04% or more and 0.15% or less, Si: 0.4% or more and 2.0% or less, Mn: 1.0% or more and 3.0% or less, P: 0.100% or less (including 0%), S: 0.0100% or less (including 0%), Al: 0.01% or more and 2.00% or less, N: 0.010% or less (including 0%), Ti: 0.03% or more and 0.15% or less, B: 0.0005% or more and 0.0050% or less, and one or two or more selected from Cr: 0.10% or more and 2.50% or less, Mo: 0.05% or more and 0.50% or less, Nb: 0.005% or more and 0.060% or less, and V: 0.05% or more and 0.50% or less, the balance being Fe and incidental impurities.

The reason for the limitation of the component composition of the high-strength hot-rolled steel sheet according to aspects of the present invention will be described below. Note that "%" that represents the component composition described below refers to "% by mass" unless otherwise specified.

C: 0.04% or More and 0.15% or Less

C is an element that improves the strength and hardenability of steel to promote the formation of bainite. C is distributed to untransformed austenite during upper bainite transformation to stabilize the untransformed austenite. The untransformed austenite is thus transformed into a lower bainite phase and/or a tempered martensite phase, and/or a martensite phase during cooling after coiling, to obtain a secondary phase. In accordance with aspects of the present invention, the C content needs to be 0.04% or more. A C content of more than 0.15% results in an increase in the secondary phase, thereby decreasing the low-temperature toughness of the hot-rolled steel sheet. Accordingly, the C content is 0.04% or more and 0.15% or less. Preferably, the C content is 0.04% or more and 0.14% or less. More preferably, the C content is 0.04% or more and 0.13% or less, even more preferably 0.05% or more and less than 0.12%.

Si: 0.4% or More and 2.0% or Less

Si is an element that contributes to solid-solution strengthening and is thus an element that contributes to an improvement in the strength of steel. Additionally, Si is effective in inhibiting the formation of carbide and inhibits the precipitation of cementite during upper bainite transformation. C is thus distributed to untransformed austenite. The untransformed austenite is transformed into a lower bainite phase and/or a tempered martensite phase, and/or a martensite phase during cooling after coiling to obtain a secondary phase. To provide these effects, the Si content needs to be 0.4% or more. Furthermore, Si is an element that forms subscales on surfaces of a steel sheet during hot rolling. A Si content of more than 2.0% results in excessively thick subscales. This leads to an excessively large arithmetic mean surface roughness (Ra) of the steel sheet after descaling, thereby deteriorating the bending formability of the hot-rolled steel sheet. Accordingly, the Si content is 2.0% or less. The Si content is preferably 0.4% or more and preferably 1.8% or less. The Si content is more preferably 0.5% or more, and more preferably 1.6% or less.

Mn: 1.0% or More and 3.0% or Less

Mn is dissolved to contribute to an increase the strength of steel and improves hardenability to promote the formation of a bainite phase and a martensite phase. To provide these effects, the Mn content needs to be 1.0% or more. A Mn content of more than 3.0% results in the increase of the martensite phase, thereby decreasing the low-temperature toughness of the hot-rolled steel sheet. Accordingly, the Mn content is 1.0% or more and 3.0% or less. Preferably, the Mn content is 1.3% or more and 2.6% or less. More preferably, the Mn content is 1.5% or more and preferably 2.4% or less.

P: 0.100% or Less (Including 0%)

P is an element that dissolves to contribute to an increase in the strength of steel. P, however, is also an element that segregates at austenite grain boundaries during hot rolling to cause cracking during the hot rolling. Even if the occurrence of cracking can be avoided, P segregates at the grain boundaries to decrease the low-temperature toughness and workability. Thus, the P content is preferably minimized. A P content up to 0.100% is acceptable. Accordingly, the P content is 0.100% or less. Preferably, the P content is 0.05% or less. More preferably, the P content is 0.02% or less.

S: 0.0100% or Less (Including 0%)

S binds to Ti and Mn to form coarse sulfides, thereby decreasing the toughness of the hot-rolled steel sheet. Thus, the S content is preferably minimized. A S content up to 0.0100% is acceptable. Accordingly, the S content is 0.0100% or less. In view of stretch-flangeability, the S content is preferably 0.005% or less. More preferably, the S content is 0.003% or less.

Al: 0.01% or More and 2.00% or Less

Al is an element that acts as a deoxidizer and thus effective in improving the cleanliness of steel. At an Al content of less than 0.01%, the effect is not always sufficient. Thus, the Al content is 0.01% or more. As with Si, Al is effective in inhibiting the formation of carbide and thus inhibits the precipitation of cementite during upper bainite transformation. Thereby, C is distributed to untransformed austenite, and the untransformed austenite is transformed into a lower bainite phase and/or a tempered martensite phase, and/or a martensite phase during cooling after coiling to obtain the secondary phase. An excessive addition of Al increases oxide inclusions to decrease the toughness of the hot-rolled steel sheet and causes defects. Accordingly, the Al content is 0.01% or more and 2.00% or less. The Al content is preferably 0.015% or more and preferably 1.8% or less. The Al content is more preferably 0.020% or more, and more preferably 1.6% or less.

N: 0.010% or Less (Including 0%)

N binds to a nitride-forming element to precipitate in the form of nitride, thereby contributing to a reduction in grain size. N, however, binds easily to Ti at a high temperature to form coarse nitride. Additionally, N is an element that causes cracking during hot rolling at a N content of more than 0.010%. Accordingly, the N content is 0.010% or less. Preferably, the N content is 0.008% or less. More preferably, the N content is 0.006% or less.

Ti: 0.03% or More and 0.15% or Less

Ti is an element effective in improving the strength of the steel sheet by precipitation strengthening or solid-solution strengthening. Ti forms nitride in an austenite-phase high-temperature range (a high-temperature range in an austenite-phase range and a higher temperature range (in a casting stage) than the austenite-phase range). This inhibits the precipitation of BN. Because B is in a dissolved state, hardenability required to form an upper bainite phase can be provided, thereby contributing to an improvement in strength. To provide these effects, the Ti content needs to be 0.03% or more. Ti increases the recrystallization temperature of the austenite phase during hot rolling to enable rolling in an austenite un-recrystallized region. This contributes to a reduction in the grain size of the upper bainite phase, thereby improving the low-temperature toughness. At a Ti content of more than 0.15%, the effect of reducing the grain size results in an increase in the number density of grains of the secondary phase (a structure composed of one or two of the lower bainite phase and/or the tempered martensite phase, and the martensite phase) having an equivalent circular diameter of 0.5 μm or more, thereby deteriorating the stretch-flangeability. Accordingly, the Ti content is 0.03% or more and 0.15% or less. The Ti content is preferably 0.04% or more and preferably 0.14% or less. The Ti content is more preferably 0.05% or more, and more preferably 0.13% or less.

B: 0.0005% or More and 0.0050% or Less

B is an element that segregates at prior austenite grain boundaries to inhibit the formation of ferrite, thereby promoting the formation of an upper bainite phase and contributing to an improvement in the strength of the steel sheet. To provide these effects, the B content is 0.0005% or more. A B content of more than 0.0050% results in the saturation of the effects. Accordingly, the B content is limited to 0.0005% or more and 0.0050% or less. The B content is preferably 0.0006% or more and preferably 0.0040% or less. The B content is more preferably 0.0007% or more, and more preferably 0.0030% or less.

In accordance with aspects of the present invention, the foregoing components are contained, and, in addition, one or two or more selected from elements described below are contained.

Cr: 0.10% or More and 2.50% or Less

Cr is an element effective in improving the strength of the steel sheet by solid-solution strengthening. Additionally, Cr is a carbide-forming element and an element effective in terminating upper bainite transformation while untransformed austenite is left because Cr segregates at the boundaries between an upper bainite phase and an untransformed austenite during the upper bainite transformation after the coiling of the hot-rolled steel sheet to reduce a driving force for bainite transformation. The untransformed austenite is transformed into a structure (secondary phase) composed of a lower bainite phase and/or a tempered martensite phase, and/or a martensite phase by the subsequent cooling. Thereby, a desired area percentage of the secondary phase can be obtained. To provide these effects, the Cr content is 0.10% or more. As with Si, Cr is an element that forms subscales on surfaces of the steel sheet during hot rolling. A Cr content of more than 2.50% results in excessively thick subscales. This leads to an excessively large arithmetic mean surface roughness (Ra) of the steel sheet after descaling, thereby deteriorating the bending formability of the hot-rolled steel sheet. Accordingly, when Cr is contained, the Cr content is 0.10% or more and 2.50% or less. The Cr content is preferably 0.15% or more and preferably 2.20% or less. The Cr content is more preferably 0.20% or more, and more preferably 2.00% or less. Even more preferably, the Cr content is 0.20% or more and 1.60% or less. Still more preferably, the Cr content is 0.20% or more and 1.00% or less.

Mo: 0.05% or More and 0.50% or Less

Mo promotes the formation of a bainite phase through an improvement in hardenability, thereby contributing to an improvement in the strength of the steel sheet. As with Cr, Mo is a carbide-forming element and an element effective in terminating upper bainite transformation while untransformed austenite is left because Mo segregates at the boundaries between an upper bainite phase and an untransformed austenite during the upper bainite transformation after the coiling of the hot-rolled steel sheet to reduce a driving force for bainite transformation. The untransformed austenite is transformed into a structure (secondary phase) composed of a lower bainite phase and/or a tempered martensite phase, and/or a martensite phase by the subsequent cooling. Thereby, a desired area percentage of the secondary phase can be obtained. To provide these effects, the Mo content is preferably 0.05% or more. However, a Mo content of more than 0.50% results in the increase of the martensite phase, thereby decreasing the low-temperature toughness of the hot-rolled steel sheet. Accordingly, when Mo is contained, the Mo content is 0.05% or more and 0.50% or less. The Mo content is preferably 0.10% or more and preferably 0.40% or less. The Mo content is more preferably 0.15% or more and, more preferably 0.30% or less.

Nb: 0.005% or More and 0.060% or Less

Nb is an element effective in improving the strength of the steel sheet by precipitation strengthening or solid-solution strengthening. As with Ti, Nb increases the recrystallization temperature of an austenite phase during hot rolling to enable rolling in an austenite un-recrystallized region. This contributes to a reduction in the grain size of the upper bainite phase, thereby improving the low-temperature toughness. To provide these effects, the Nb content needs to be 0.005% or more. At a Nb content of more than 0.060%, the effect of reducing the grain size results in an increase in the number density of grains of the secondary phase having an equivalent circular diameter of 0.5 μm or more, thereby deteriorating the stretch-flangeability. Accordingly, when Nb is contained, the Nb content is 0.005% or more and 0.060% or less. The Nb content is preferably 0.010% or more and preferably 0.050% or less. The Nb content is more preferably 0.015% or more, and more preferably 0.040% or less.

V: 0.05% or More and 0.50% or Less

V is an element effective in improving the strength of the steel sheet by precipitation strengthening or solid-solution strengthening. As with Ti, V increases the recrystallization temperature of an austenite phase during hot rolling to enable rolling in an austenite un-recrystallized region. This contributes to a reduction in the grain size of the upper bainite phase, thereby improving the low-temperature toughness. To provide these effects, the V content needs to be 0.05% or more. At a V content of more than 0.50%, the effect of reducing the grain size results in an increase in the number density of grains of the secondary phase having an equivalent circular diameter of 0.5 μm or more, thereby deteriorating the stretch-flangeability. Accordingly, when V is contained, the V content is 0.05% or more and 0.50% or less. The V content is preferably 0.10% or more and preferably 0.40% or less. The V content is more preferably 0.15% or more and, more preferably 0.30% or less.

In accordance with aspects of the present invention, the balance other than the foregoing components is composed of Fe and incidental impurities. Examples of the incidental impurities include Zr, Co, Sn, Zn, and W. It is acceptable if the total content thereof is 0.5% or less.

Owing to the foregoing essential elements, the steel sheet according to aspects of the present invention can obtain the desired properties. To further improve the strength, the press formability, the low-temperature toughness, and so forth, the hot-rolled steel sheet according to aspects of the present invention may contain elements described below, as needed.

One or Two Selected From Cu: 0.01% or More and 0.50% or Less and Ni: 0.01% or More and 0.50% or Less Cu: 0.01% or More and 0.50% or Less Cu is dissolved to contribute to an increase in the strength of steel. Additionally, Cu promotes the formation of a bainite phase through an improvement in hardenability, thereby contributing to an improvement in strength. To provide these effects, the Cu content is preferably 0.01% or more. A Cu content of more than 0.50% leads to the degradation of surface properties of the hot-rolled steel sheet, thereby deteriorating the bending formability of the hot-rolled steel sheet. Accordingly, when Cu is contained, the Cu content is 0.01% or more and 0.50% or less. The Cu content is preferably 0.05% or more and preferably 0.30% or less.

Ni: 0.01% or More and 0.50% or Less

Ni is dissolved to contribute to an increase in the strength of steel. Additionally, Ni promotes the formation of a bainite phase through an improvement in hardenability, thereby contributing to an improvement in strength. To provide these effects, the Ni content is preferably 0.01% or more. However, a Ni content of more than 0.50% results in the increase of a martensite phase, thereby decreasing the low-temperature toughness of the hot-rolled steel sheet. Accordingly, when Ni is contained, the Ni content is 0.01% or more and 0.50% or less. The Ni content is preferably 0.05% or more and preferably 0.30% or less.

Sb: 0.0002% or More and 0.0200% or Less

Sb is effective in inhibiting the nitriding of surfaces of a slab in a slab heating stage, thereby inhibiting the precipitation of BN at surface layer portions of the slab. The presence of dissolved B enables hardenability required to form bainite to be obtained at surface layer portions of the hot-rolled steel sheet, thereby improving the strength of the hot-rolled steel sheet. To provide these effects, the Sb content needs to be 0.0002% or more. An Sb content of more than 0.0200% leads to an increase in rolling load, thereby decreasing the productivity. Accordingly, when Sb is contained, the Sb content is 0.0002% or more and 0.0200% or less. The Sb content is preferably 0.0005% or more and preferably 0.0180% or less. The Sb content is more preferably 0.0010% or more and, more preferably 0.0150% or less.

One or Two or More Selected From Ca: 0.0002% or More and 0.0100% or Less, Mg: 0.0002% or More and 0.0100% or Less, and REM: 0.0002% or More and 0.0100% or Less Ca: 0.0002% or More and 0.0100% or Less Ca is effective in controlling the shapes of inclusions of oxides and sulfides to improve the low-temperature toughness of the hot-rolled steel sheet. To provide these effects, the Ca content is preferably 0.0002% or more. However, a Ca content of more than 0.0100% may result in surface defects of the hot-rolled steel sheet, thereby deteriorating the bending formability of the hot-rolled steel sheet. Accordingly, when Ca is contained, the Ca content is 0.0002% or more and 0.0100% or less. The Ca content is preferably 0.0004% or more and 0.0050% or less.

Mg: 0.0002% or More and 0.0100% or Less

As with Ca, Mg is effective in controlling the shapes of inclusions of oxides and sulfides to improve the low-temperature toughness of the hot-rolled steel sheet. To provide these effects, the Mg content is preferably 0.0002% or more. However, a Mg content of more than 0.0100% results in a decrease in the cleanliness of steel, thereby decreasing the low-temperature toughness. Accordingly, when Mg is contained, the Mg content is 0.0002% or more and 0.0100% or less. The Mg content is preferably 0.0004% or more and preferably 0.0050% or less.

REM: 0.0002% or More and 0.0100% or Less

As with Ca, REM is effective in controlling the shapes of inclusions of oxides and sulfides to improve the low-temperature toughness of the hot-rolled steel sheet. To provide these effects, the REM content is preferably 0.0002% or more. However, a REM content of more than 0.0100% results in a decrease in the cleanliness of steel, thereby decreasing the low-temperature toughness. Accordingly, when REM is contained, the REM content is 0.0002% or more and 0.0100% or less. The REM content is preferably 0.0004% or more and preferably 0.0050% or less.

The reason for the limitation of the microstructure and so forth of the high-strength hot-rolled steel sheet according to aspects of the present invention will be described below.

The high-strength hot-rolled steel sheet according to aspects of the present invention has a microstructure containing 75.0% or more by area and less than 97.0% by area percentage of a primary phase composed of an upper bainite phase, the primary phase having an average grain size of 12.0 μm or less, and more than 3.0% by area percentage and 25.0% or less by area percentage of a secondary phase that is a structure composed of one or two of a lower bainite phase and/or a tempered martensite phase, and a martensite phase, in which the number density of grains of the secondary phase having an equivalent circular diameter of 0.5 μm or more is 150,000 grains/mm$^2$ or less, and the steel sheet has an arithmetic mean surface roughness (Ra) of 2.00 μm or less. The balance is composed of a retained austenite phase, a pearlite phase, and a ferrite phase. When the total area percentage of the retained austenite phase, the pearlite phase, and the ferrite phase is 0% to less than 3.0%, the advantageous effects achieved in accordance with aspects of the present invention are obtained.

Microstructure of Hot-Rolled Steel Sheet

Primary Phase: 75.0% or more by area percentage and less than 97.0% by area percentage of Upper Bainite Phase, and Upper Bainite Phase Having Average Grain Size of 12.0 μm or less Secondary Phase: more than 3.0% by area percentage and 25.0% or less by area percentage of Structure (Secondary Phase) Composed of One or Two of Lower Bainite Phase and/or Tempered Martensite Phase, and Martensite Phase, and Number Density of Grains of Secondary Phase with Equivalent Circular Diameter of 0.5 μm or more being 150,000 grains/mm$^2$ or less Balance: Total Area Percentage of Retained Austenite Phase, Pearlite Phase, and Ferrite Phase Being 0% or More and Less than 3.0%

The high-strength hot-rolled steel sheet according to aspects of the present invention contains a primary phase composed of an upper bainite phase. The "upper bainite phase" refers to a structure containing an Fe-based carbide and/or a retained austenite phase between lath-like bainite ferrite grains (however, the upper bainite phase also includes the case where there is no Fe-based carbide or retained austenite phase between lath-like bainite ferrite grains). Unlike polygonal ferrite, bainitic ferrite has a lath-like shape and a relatively high dislocation density therein and thus can be easily distinguished with a scanning electron microscope (SEM) or a transmission electron microscope (TEM). To achieve strength, i.e., a tensile strength, TS, of 980 MPa or more, and increase the low-temperature toughness, the primary phase needs to be the upper bainite phase. In the case where the area percentage of the upper bainite phase is 75.0% or more and where the upper bainite phase has an average grain size of 12.0 μm or less, both of a tensile strength, TS, of 980 MPa or more and good low-temperature toughness can be obtained. If the area percentage of the upper bainite phase is 97.0% or more, the yield ratio (YR) of the steel sheet is more than 92.0%, thereby failing to obtain good stretch formability. Accordingly, the area percentage of the upper bainite phase is 75.0% or more and less than 97.0%. The area percentage of the upper bainite phase is preferably 80.0% or more, more preferably 85.0% or more. The upper bainite phase preferably has an average grain size of 11.0 μm or less, more preferably 10.0 μm or less, even more preferably 9.0 μm or less.

In accordance with aspects of the present invention, the secondary phase is a structure composed of one or two of the lower bainite phase and/or the tempered martensite phase, and the martensite phase. When the area percentage of the secondary phase is more than 3.0%, good stretch formability is obtained. When the area percentage of the secondary phase is more than 25.0%, no matter how small the average grain size of the primary phase, good low-temperature toughness cannot be ensured. Accordingly, the area percentage of the secondary phase is more than 3.0% and 25.0% or less. The area percentage of the secondary phase is preferably 3.5% or more and preferably 23.0% or less, more preferably 4.0% or more, more preferably 20.0% or less, even more preferably 4.5% or more, even more preferably 15.0% or less. The lower bainite phase and/or the tempered martensite refers to a structure containing an Fe-based carbide in a lath-like bainitic ferrite (however, it also includes the case where an Fe-based carbide is also contained between the bainitic ferrite grains). Although the lower bainite and the tempered martensite can be distinguished from each other by observing the orientation and the crystal structure of the Fe-based carbide in the lath with a transmission electron microscope (TEM), because they have substantially the same properties, they are not distinguished from each other in accordance with aspects of the present invention. Additionally, since they have a higher dislocation density than upper bainite, they can be distinguished with a SEM or transmission electron microscope (TEM).

In the case where the number density of the grains of the secondary phase having an equivalent circular diameter of 0.5 μm or more is 150,000 grains/mm$^2$ or less, voids formed at boundaries between the upper bainite phase and the secondary phase are not easily connected to each other during stretch flanging, thereby ensuring high stretch-flangeability. A lower number density of the grains of the secondary phase having an equivalent circular diameter of 0.5 μm or more results in better stretch-flangeability. Accordingly, the number density of the grains of the secondary phase having an equivalent circular diameter of 0.5 μm or more is preferably 130,000 grains/mm$^2$ or less, more preferably 115,000 grains/mm$^2$ or less, even more preferably 100,000 grains/mm$^2$ or less.

Structures other than the primary phase composed of the upper bainite phase or the secondary phase that is a structure composed of one or two of the lower bainite phase and/or the tempered martensite phase, and the martensite phase are a retained austenite phase, a pearlite phase, and a ferrite phase (however, the structures include the case where each phase is not contained).

Surface of Hot-Rolled Steel Sheet

Arithmetic Mean Roughness (Ra) of 2.00 μm or Less

A large arithmetic mean surface roughness (Ra) of the steel sheet can result in the occurrence of local stress concentration at the apex portion of a bend during bending, thereby possibly causing a break. To ensure good bending workability of the high-strength hot-rolled steel sheet, thus, the steel sheet has an arithmetic mean surface roughness (Ra) of 2.00 μm or less. A smaller arithmetic mean surface roughness (Ra) of the steel sheet results in better bending workability. Thus, the steel sheet preferably has an arithmetic mean surface roughness (Ra) of 1.90 μm or less, more preferably 1.80 μm or less, even more preferably 1.60 μm or less.

Surface Treatment of Steel Sheet (Preferred Condition)

To improve corrosion resistance and so forth, the steel sheet having the microstructure and so forth may be a surface-treated steel sheet including a coated layer on each surface thereof. The coated layer may be a hot-dip coated layer or an electroplated layer. An example of the hot-dip coated layer is a galvanized layer, such as hot-dip galvanizing layer or hot-dip galvannealing layer. As the electroplated layer, electrogalvanizing layer is exemplified. The coating weight is not particularly limited and may be the same as the related art.

The area percentages of the upper bainite phase, the lower bainite phase and/or the tempered martensite phase (secondary phase), the martensite phase (secondary phase), the retained austenite phase, the pearlite phase, and the ferrite phase, the average grain size of the upper bainite phase, the number density of grains of the secondary phase having an equivalent circular diameter of 0.5 μm or more, and the arithmetic mean surface roughness (Ra) of the steel sheet can be measured by methods described in examples below.

A method for producing the high-strength hot-rolled steel sheet according to aspects of the present invention will be described below. In the description, the expression "° C." relating to temperature refers to the temperature of a surface of a steel sheet or steel.

According to aspects of the present invention, the method for producing the high-strength hot-rolled steel sheet includes heating a steel having the composition to 1,150° C. or higher, then performing hot rolling including, after performing rough rolling, performing descaling with high-pressure water at an impact pressure of 3.0 MPa or more before finish rolling, and performing the finish rolling, in which letting an RC temperature be defined by formula (1), the total rolling reduction is 50% or more at the RC temperature or higher and then 80% or less at lower than the RC temperature, and the finishing temperature is (RC−100° C.) or higher and (RC+100° C.) or lower, then starting cooling within 2.0 s after completion of the finish rolling, in which letting an Ms temperature be defined by formula (2), the cooling is performed to a cooling stop temperature of higher than the Ms temperature and 600° C. or lower at an average cooling rate of 30° C./s or more, performing coiling at the cooling stop temperature, and then cooling a steel sheet to (Ms−100° C.) at an average cooling rate of 0.20° C./min or more. After the cooling subsequent to the coiling is performed, a surface of the steel sheet may be subjected to coating treatment.

Details will be described below.

In accordance with aspects of the present invention, a method for producing a steel need not be particularly limited. Any usual method may be employed which includes making a molten steel with the foregoing composition by a known method using, for example, a converter and forming a steel such as a slab by a casting method such as continuous casting. A known casting method such as an ingot-making, slabbing rolling method may be employed. Scrap may be used as a raw material.

Cast Slab: Direct Rolling of Cast Slab or Heating Hot or Cold Slab (Steel) to 1,150° C. or Higher In the steel such as a slab that has been cooled to a low temperature, most of carbonitride-forming elements such as Ti are present in the form of coarse carbonitrides. The presence of the coarse nonuniform precipitates leads to the deterioration in various properties (such as strength and low-temperature toughness) of the hot-rolled steel sheet. Thus, the steel before hot rolling is directly subjected to hot rolling (direct rolling) with a high temperature after casting. Alternatively, the steel before hot rolling is heated to dissolve the coarse precipitates. When the slab is heated, the heating temperature of the steel needs to be 1,150° C. or higher in order to sufficiently dissolve the coarse precipitates before hot rolling. An excessively high heating temperature of the steel leads to the formation of slab defects and a decrease in yield due to scale off. Thus, the heating temperature of the steel is preferably 1,350° C. or lower. The heating temperature of the steel is more preferably 1,180° C. or higher and preferably 1,300° C. or lower, even more preferably 1,200° C. or higher and even more preferably 1,280° C. or lower.

The steel is heated to 1,150° C. or higher and held for a predetermined time. A holding time of more than 9,000 s results in an increase in the amount of scale formed. This facilitates the occurrence of scale biting and so forth during the subsequent hot rolling step. The surface roughness of the hot-rolled steel sheet tends to be degraded to deteriorate the bending formability. Accordingly, the holding time of the steel in the temperature range of 1,150° C. or higher is preferably 9,000 s or less. More preferably, the holding time of the steel in the temperature range of 1,150° C. or higher is 7,200 s or less. The lower limit of the holding time is not particularly specified. In view of the uniformity of slab heating, the holding time of the steel in the temperature range of 1,150° C. or higher is preferably 1,800 s or more.

Hot Rolling: After Performing Rough Rolling, Descaling Is Performed with High-Pressure Water at Impact Pressure of 3.0 MPa or more Before Finish Rolling, in Which Letting RC Temperature Be Defined by Formula (1) in Finish Rolling, Total Rolling Reduction Is 50% or more at RC Temperature or higher and then 80% or less at lower than RC Temperature, and Finishing Temperature Is (RC−100° C.) or higher and (RC+100° C.) or lower.

In accordance with aspects of the present invention, the heating of the steel is followed by hot rolling including rough rolling and finish rolling. In the rough rolling, a sheet bar having desired dimensions may be ensured. The conditions thereof need not be particularly limited. After the rough rolling, descaling with high-pressure water is performed on the entry side of a finishing mill before the finish rolling.

Impact Pressure of High-Pressure Water in Descaling: 3.0 MPa or More

To remove primary scale formed before the finish rolling, descaling treatment is performed by high-pressure water jetting. To control the arithmetic mean surface roughness (Ra) of the high-strength hot-rolled steel sheet to 2.00 μm or less, the impact pressure of the high-pressure water in the descaling needs to be 3.0 MPa or more. The upper limit is not particularly limited. The descaling is performed at an impact pressure of preferably 3.0 MPa or more and preferably 12.0 MPa or less. The descaling may be performed between stands in the finish rolling in the course of rolling. The steel sheet may be cooled between the stands, as needed.

The impact pressure used in the above description refers to a force per unit area at which high-pressure water collides with a surface of the steel.

Letting RC Temperature be Defined by Formula (1), Total Rolling Reduction at RC Temperature or Higher: 50% or More The inventors have found empirically from experiments that rolling the hot-rolled steel sheet at the RC temperature or higher significantly leads to the recrystallization in the austenite range of steel. In the case of coarse austenite grains, the upper bainite phase after transformation has a large grain size; thus, the target good low-temperature toughness in accordance with aspects of the present invention is difficult to obtain. To ensure good low-temperature toughness, it is necessary to sufficiently recrystallize the austenite grains during the finish rolling. The total rolling reduction in the finish rolling at the RC temperature or higher needs to be 50% or more. The total rolling reduction in the finish rolling at the RC temperature or higher is preferably 55% or more, more preferably 60% or more, even more preferably 70% or more.

$$RC\ (^\circ\ C.)=850+100\times C+100\times N+10\times Mn+700\times Ti+5{,}000\times B+10\times Cr+50\times Mo+2{,}000\times Nb+150\times V\ \ldots \quad \text{formula (1)}$$

where each element symbol in formula (1) indicates the element content (% by mass) of the steel, and when an element is not contained, the element symbol in the formula is calculated as 0.

Total Rolling Reduction in Finish Rolling at Lower than RC Temperature: 80% or Less In the case where the reduction is performed at lower than the RC temperature, austenite grains do not recrystallize to cause strain to accumulate, and a deformation zone is introduced. The formation of the strain and the deformation zone in the austenite grains increases the number of transformation nuclei to result in the transformed upper bainite phase having a small grain size, thereby improving the low-temperature toughness of the hot-rolled steel sheet. However, when the total rolling reduction at lower than the RC temperature is more than 80%, the number density of grains of the secondary phase that has an equivalent circular diameter of 0.5 μm or more and that is the structure composed of one or two of the lower bainite phase and/or the tempered martensite phase, and the martensite phase is excessively increased, thereby deteriorating the stretch-flangeability of the hot-rolled steel sheet. Accordingly, the total rolling reduction in the finish rolling at lower than the RC temperature is 80% or less. In view of the stretch-flangeability, the total rolling reduction in the finish rolling at lower than the RC temperature is preferably 70% or lower, more preferably 60% or lower, even more preferably 50% or lower. The lower limit is not particularly specified. In view of the low-temperature toughness of the hot-rolled steel sheet, the total rolling reduction in the finish rolling at lower than the RC temperature is preferably 10% or more.

Finishing Temperature: (RC−100° C.) or Higher and (RC+100° C.) or Lower

In the case where the finishing temperature is lower than (RC−100° C.), because rolling can be performed in a ferrite-austenite dual-phase temperature region, a desired area percentage of the upper bainite phase is not obtained, thereby failing to ensure a tensile strength, TS, of 980 MPa or more. If a ferrite-austenite dual-phase region is not obtained, the grain size is excessively small; thus, the number density of grains of the secondary phase having an equivalent circular diameter of 0.5 μm or more is increased to deteriorate the stretch-flangeability. In the case where the finishing temperature is higher than (RC+100° C.), recrystallized austenite grains grow markedly to coarsen the austenite grains. This increases the average grain size of the upper bainite phase to fail to ensure the target good low-temperature toughness in accordance with aspects of the present invention. Accordingly, the finishing temperature is (RC−100° C.) or higher and (RC+100° C.) or lower, preferably (RC−90° C.) or higher and preferably (RC+90° C.) or lower, more preferably (RC−70° C.) or higher and more preferably (RC+70° C.) or lower, even more preferably (RC−50° C.) or higher and even more preferably (RC+50° C.) or lower. The finishing temperature used here refers to the surface temperature of the steel sheet.

Cooling Start Time: Within 2.0 s After Completion of Finish Rolling

Forced cooling is started within 2.0 s after the completion of the finish rolling. The cooling is stopped at a cooling stop temperature (coiling temperature), and the resulting steel sheet is wound in the form of a coil. In the case where the time from the completion of the finish rolling to the start of the forced cooling is more than 2.0 s, if the finishing temperature is the RC temperature or higher, the austenite grains grow to increase the grain size of the upper bainite phase, thereby failing to obtain the target good low-temperature toughness in accordance with aspects of the present invention. If the finishing temperature is lower than the RC temperature, the upper limit of the start time of the forced cooling need not be particularly specified. Because the strain introduced into the austenite grains is recovered, the forced cooling start time is preferably within 2.0 s in view of the low-temperature toughness. Accordingly, the forced cooling start time is within 2.0 s after the completion of the finish rolling. Preferably, the forced cooling start time is within 1.5 s after the completion of the finish rolling. More preferably, the forced cooling start time is within 1.0 s after the completion of the finish rolling.

Average Cooling Rate From Finishing Temperature to Cooling Stop Temperature (Coiling Temperature): 30° C./s or More When the average cooling rate from the finishing temperature to the coiling temperature in the forced cooling is less than 30° C./s, ferrite transformation occurs before upper bainite transformation, thereby failing to obtain a desired area percentage of the upper bainite phase. Accordingly, the average cooling rate is 30° C./s or more. The average cooling rate is preferably 35° C./.s or more, more preferably 40° C./s or more. The upper limit of the average cooling rate is not particularly specified. However, an excessively high average cooling rate may make it difficult to control the cooling stop temperature and may it difficult to obtain a desired microstructure. Accordingly, the average cooling rate is preferably 300° C./s or less. The average cooling rate is specified on the basis of an average cooling rate on a surface of the steel sheet.

Cooling Stop Temperature (Coiling Temperature): Higher Than Ms Temperature and 600° C. or Lower Regarding the cooling stop temperature (coiling temperature), letting an Ms temperature be defined by formula (2), when cooling is stopped at higher than the Ms temperature, a bainite transformation stasis phenomenon occurs to interrupt the upper bainite transformation. Thus, the microstructure is held in a two-phase state: the upper bainite phase and the untransformed austenite phase. Then untransformed austenite is transformed into the lower bainite phase and/or the tempered martensite phase, and/or the martensite phase in the course of the cooling of the hot-rolled steel sheet to obtain the desired area percentage of the upper bainite phase and the desired area percentage of the secondary phase that is a structure composed of one or two of the lower bainite phase and/or the tempered martensite phase, and the martensite phase. However, when coiling temperature is the Ms temperature or lower, the bainite transformation stasis phenomenon does not occur to fail to ensure the desired area percentage of the secondary phase, thereby causing the stretch formability to deteriorate. When the coiling temperature is higher than 600° C., the ferrite phase and the pearlite phase are formed to fail to ensure the desired tensile strength, TS, of 980 MPa or more. In other words, a reduction in coiling temperature has a tendency to cause an increase in driving force for the upper bainite transformation to increase the percentage of the upper bainite transformed until the time when the bainite transformation stasis phenomenon occurs; thus, the area percentage of the secondary phase of the hot-rolled steel sheet tends to decrease. Additionally, an increase in coiling temperature has a tendency to cause a reduction in the driving force for the upper bainite transformation to reduce the percentage of the upper bainite transformed until the time when the bainite transformation stasis phenomenon occurs; thus, the area percentage of the secondary phase of the hot-rolled steel sheet tends to increase. Accordingly, the coiling temperature is higher than the Ms temperature and 600° C. or lower. The coiling temperature is preferably (Ms+10° C.) or higher and preferably 580° C. or lower, more preferably (Ms+20° C.) or higher and more preferably 560° C. or lower.

$$Ms\ (^\circ C.)=561-474\times C-33\times Mn-17\times Ni-21\times Mo \quad \text{formula (2)}$$

where each element symbol in formula (2) indicates the element content (% by mass) of the steel, and when an element is not contained, the element symbol in the formula is calculated as 0.

After Coiling, Hot-Rolled Steel Sheet Is Cooled to (Ms−100° C.) at Average Cooling Rate of 0.20° C./min or more Average Cooling Rate to (Ms−100° C.) after coiling: 0.20° C./min or more The average cooling rate of the hot-rolled steel sheet after the coiling affects the transformation behavior of the untransformed austenite phase. The cooling of the hot-rolled steel sheet after the coiling may be performed by any cooling method as long as a desired average cooling rate is obtained. Examples of the cooling method include natural air cooling, forced air cooling, gas cooling, mist cooling, water cooling, and oil cooling. When the average cooling rate of the coiled, hot-rolled steel sheet to (Ms−100° C.) is less than 0.20° C./min, the untransformed austenite phase is decomposed into the upper bainite phase or the pearlite phase to fail to ensure the desired area percentage of the secondary phase that is a structure composed of one or two of the lower bainite phase and/or the tempered martensite phase, and the martensite phase. Accordingly, in order to transform the untransformed austenite phase into the secondary phase to obtain the desired area percentage of the secondary phase, the average cooling rate of the coiled, hot-rolled steel sheet to (Ms−100° C.) needs to be 0.20° C./min or more, preferably 0.25° C./min or more, more preferably 0.30° C./min or more, even more preferably 0.50° C./min or more. The upper limit of the average cooling rate is not particularly specified. At an excessively high average cooling rate, the bainite transformation stasis phenomenon does not occur, thereby making it difficult to obtain the desired area percentage of the secondary phase that is a structure composed of one or two of the lower bainite phase and/or the tempered martensite, and the martensite phase, in some cases. Accordingly, the average cooling rate is preferably less than 1,800° C./min, more preferably 600° C./min or less, even more preferably 60° C./min or less.

At higher than (Ms−100° C.), because the transformation of the untransformed austenite phase is not completed, retained austenite may be formed (left) to fail to obtain the desired microstructure. Accordingly, in the cooling after the coiling, in particular, the average cooling rate to (Ms−100° C.), preferably (Ms−150° C.), more preferably (Ms−200° C.), needs to be controlled.

As described above, the high-strength hot-rolled steel sheet according to aspects of the present invention is produced.

In accordance with aspects of the present invention, in order to reduce segregation of the steel components during continuous casting, electromagnetic stirring (EMS), intentional bulging soft reduction (IBSR), and so forth may be used. When electromagnetic stirring processing is performed, equiaxed grains can be formed in a middle portion of the slab in the thickness direction to reduce segregation. When the intentional bulging soft reduction is performed, the flow of molten steel in an unsolidified portion of a continuous casting slab is prevented to reduce segregation in the middle portion of the slab in the thickness direction. The use of at least one of these segregation reduction processes enables the press formability and the low-temperature toughness to be further improved to higher levels.

After the coiling, according to the usual manner, temper rolling may be performed, or pickling may be performed to remove scales on the surfaces. Furthermore, coating treatment or chemical conversion treatment may be performed with a commonly used galvanizing line after the pickling treatment or the temper rolling. An example of the coating treatment is a treatment in which the steel sheet is passed through a galvanizing bath to form zinc-coated layers on surfaces of the steel sheet. Furthermore, an alloying treatment in which the zinc-coated layers are subjected to alloying treatment may be performed to form a galvannealed steel sheet. For example, after the coating treatment, the alloying treatment is performed at an alloying treatment temperature of 460° C. to 600° C. for a holding time of 1 s or more. In addition to the galvanized steel sheet, the resulting hot-rolled steel sheet may be subjected to electroplating treatment to form a plated steel sheet such as an electrogalvanized steel sheet.

EXAMPLES

Molten steels having compositions given in Table 1 were made in a converter and formed into steel slabs (steels) by a continuous casting method. These steels were heated under production conditions given in Table 2, subjected to rough rolling, descaling of surfaces of steel sheets under conditions given in Table 2, and finish rolling under conditions given in Table 2. After the completion of the finish rolling, each steel sheet was cooled from a cooling start time (a time from the completion of the finish rolling to the start of cooling (forced cooling)) at an average cooling rate (an average cooling rate from the finishing temperature to the coiling temperature) given in Table 2. The steel sheet was coiled at a coiling temperature given in Table 2 (cooling stop temperature). The coiled steel sheet was cooled under conditions given in Table 2 into a hot-rolled steel sheet having a sheet thickness given in Table 2. The resulting hot-rolled steel sheets were subjected to temper rolling and then pickling (concentration of hydrochloric acid: 10% by mass, temperature: 85° C.). Some of them were subjected to galvanizing treatment and then alloying treatment.

Test pieces were taken from the resulting hot-rolled steel sheets. The measurement of the arithmetic mean surface roughness (Ra) of the hot-rolled steel sheets, microstructure observation, a tensile test, a hole expanding test, a bending test, and the Charpy impact test were performed. A method for observing a microstructure and various test methods are described below. In the case of a coated steel sheet, the steel sheet in the coated state was tested and evaluated.

(i) Measurement of Arithmetic Mean Surface Roughness (Ra) of Hot-Rolled Steel Sheet Test pieces (dimensions: t (sheet thickness)×50 mm (width)×50 mm (length)) for measuring the arithmetic mean surface roughness of the resulting steel sheets were taken from the steel sheets. The arithmetic mean roughness (Ra) was measured according to JIS B0601. The measurement of the arithmetic mean roughness (Ra) was performed three times in each of the rolling direction and the direction perpendicular thereto, and the average value was calculated and evaluated. In the case of the coated sheet, Ra of the steel sheet in the coated state was determined. In the case of the hot-rolled steel sheet, Ra of the steel sheet that had been subjected to pickling to remove the scales was determined.

(ii) Microstructure Observation

Area Percentage of Structure, Number Density of Secondary Phase (Structure Composed of One Or Two of Lower Bainite Phase and/or Tempered Martensite Phase, and Martensite Phase), Equivalent Circular Diameter of Grain of Secondary Phase, and Average Grain Size of Upper Bainite A test piece for a scanning electron microscope (SEM) was taken from each of the resulting hot-rolled steel sheets.

After a section in the sheet-thickness direction, the section being parallel to the rolling direction, was polished, the microstructure was exposed with an etchant (3% by weight nital solution). Ten fields of view were captured at a ¼ position of the sheet thickness with a scanning electron microscope (SEM) at a magnification of ×3,000. The area percentages of the phases (an upper bainite phase, a lower bainite phase and/or a tempered martensite phase, a martensite phase, a pearlite phase, and a ferrite phase) were quantified. The equivalent circular diameter of grains of the secondary phase (a structure composed of one or two of the lower bainite phase and/or the tempered martensite phase, and the martensite phase) in each field of view was measured. Then the number of grains of the secondary phase per 1 $mm^2$ was measured to determine the number density of grains of the secondary phase having an equivalent circular diameter of 0.5 μm or more.

The average grain size of the upper bainite phase was determined as follows: A test piece for measuring the grain size of the upper bainite phase with a SEM using an electron backscatter diffraction patterns (EBSD) method was taken from each of the hot-rolled steel sheets. A surface parallel to the rolling direction was selected as an observation surface and subjected to finish polishing with a colloidal silica solution. Then 10 portions each having an area of 100 μm×100 μm at a ¼ position of the sheet thickness were measured with an EBSD measurement apparatus at an acceleration voltage of an electron beam of 20 keV in measurement steps of 0.1 μm. A grain orientation difference is defined to be 15° being a threshold value of a high-angle tilt grain boundary, which is generally recognized as a grain boundary. Grain boundaries each having a grain orientation difference of 15° or more were visualized. The average grain size of the upper bainite phase was then calculated. The area fraction average grain size of the upper bainite phase was calculated using TSL OIM Analysis software. Here, the grains were defined by setting the grain tolerance angle to 15°, thereby enabling the determination of the area fraction average grain size (referred to as an "average grain size"). A phase identified by the EBSD method as austenite was defined as a retained austenite phase. The area percentage of the retained austenite was determined.

(iii) Tensile Test

JIS No. 5 test pieces (GL: 50 mm) were taken from the resulting hot-rolled steel sheets in such a manner that the tensile direction was perpendicular to the rolling direction. A tensile test was performed in conformity with JIS Z 2241 to determine the yield strength (yield point, YP), the tensile strength (TS), and the total elongation (El). The test was performed twice. The average values thereof were used as values of the mechanical properties of the steel sheets. The yield ratio (YR) defined by the following formula was calculated:

$$YR\ (\%)=YP/TS\times 100$$

In accordance with aspects of the present invention, the case where YR determined by the tensile test was 92.0% or less was evaluated as good stretch formability.

(iv) Hole Expanding Test

Test pieces (dimensions: t (sheet thickness)×100 mm (width)×100 mm (length)) for a hole expanding test were taken from the resulting hot-rolled steel sheets. A hole was formed by punching with a punch having a diameter of 10 mm at the center of each test piece with a clearance of 12%±1% in conformity with The Japan Iron and Steel Federation Standard JFST 1001. Then a conical punch with a top angle of 60° was forcedly inserted into the resulting hole in the punching direction so as to be pushed up. The diameter d (mm) of the hole when a crack penetrated through the sheet in the thickness direction was determined. A hole expansion ratio λ(%) defined by the following formula was calculated:

$$\lambda(\%)=\{(d-10)/10\}\times 100$$

The clearance refers to a percentage (%) with respect to the sheet thickness. In accordance with aspects of the present invention, the case where λ determined by the hole expanding test was 50% or more was evaluated as good stretch-flangeability.

(v) Bending Test

After the resulting hot-rolled steel sheets were subjected to shearing, bending test pieces each measuring 35 mm (width)×100 mm (length) were taken in such a manner that the longitudinal direction of each test piece was perpendicular to the rolling direction. A V-block 90° bending test was performed on the test piece having a shear plane in accordance with a pressing bend method prescribed in JIS Z 2248. Here, the test was performed on three test pieces for each steel sheet. The minimum bending radius at which no crack was formed in any test piece was defined as a limit bending radius R (mm). An R/t value was determined by dividing R by the thickness t (mm) of the hot-rolled steel sheet. Thereby, the bending workability of the hot-rolled steel sheet was evaluated. In accordance with aspects of the present invention, the case where the R/t value was 1.20 or less was evaluated as good bending workability.

(vi) Charpy Impact Test

Subsize test pieces (V-notch) having a thickness of 2.5 mm were taken from the resulting hot-rolled steel sheets in such a manner that the longitudinal direction of each test piece was perpendicular to the rolling direction. The Charpy impact test was performed in accordance with JIS Z 2242 to measure a ductile-to-brittle fracture transition temperature (vTrs). Thereby, toughness was evaluated. Here, in the case of the hot-rolled steel sheet having a sheet thickness of more than 2.5 mm, the sheet thickness was reduced to 2.5 mm by double-sided grinding, and then the test pieces were formed. In the case of the hot-rolled steel sheet having a sheet thickness of 2.5 mm or less, the test pieces were formed at the original thickness and then subjected to the Charpy impact test. In accordance with aspects of the present invention, the case where the measured vTrs was −40° C. or lower was evaluated as good low-temperature toughness.

Table 3 presents the results obtained as described above.

TABLE 1

| | Component composition (% by mass) | | | | | | | | | |
|---|---|---|---|---|---|---|---|---|---|---|
| Steel | C | Si | Mn | P | S | Al | N | Ti | B | Cr |
| A | 0.092 | 0.67 | 2.00 | 0.010 | 0.0008 | 0.048 | 0.0031 | 0.092 | 0.0018 | 0.24 |
| B | 0.065 | 0.75 | 1.78 | 0.011 | 0.0012 | 0.055 | 0.0045 | 0.109 | 0.0016 | 0.62 |
| C | 0.060 | 0.62 | 1.10 | 0.008 | 0.0024 | 0.065 | 0.0028 | 0.040 | 0.0007 | 2.45 |

TABLE 1-continued

| | | | | | | | | | | |
|---|---|---|---|---|---|---|---|---|---|---|
| D | 0.041 | 1.32 | 2.50 | 0.027 | 0.0015 | 0.047 | 0.0068 | 0.092 | 0.0045 | 0.16 |
| E | 0.148 | 1.45 | 1.50 | 0.020 | 0.0005 | 0.056 | 0.0035 | 0.080 | 0.0012 | 0.30 |
| F | 0.050 | 0.85 | 2.96 | 0.014 | 0.0023 | 0.047 | 0.0038 | 0.085 | 0.0013 | 0.20 |
| G | 0.057 | 0.72 | 2.32 | 0.013 | 0.0009 | 0.043 | 0.0040 | 0.102 | 0.0015 | 0.25 |
| H | 0.064 | 1.05 | 1.95 | 0.019 | 0.0028 | 0.041 | 0.0098 | 0.101 | 0.0007 | 0.23 |
| I | 0.072 | 0.90 | 1.98 | 0.034 | 0.0008 | 0.041 | 0.0041 | 0.052 | 0.0019 | 0.16 |
| J | 0.090 | 0.70 | 2.10 | 0.029 | 0.0012 | 0.031 | 0.0044 | 0.096 | 0.0022 | — |
| K | 0.063 | 1.07 | 1.80 | 0.012 | 0.0039 | 0.028 | 0.0035 | 0.113 | 0.0023 | — |
| L | 0.067 | 0.56 | 1.40 | 0.015 | 0.0008 | 0.015 | 0.0041 | 0.100 | 0.0009 | — |
| M | 0.055 | 1.10 | 1.46 | 0.002 | 0.0022 | 0.047 | 0.0032 | 0.082 | 0.0015 | 0.25 |
| N | 0.074 | 0.52 | 1.96 | 0.008 | 0.0095 | 0.380 | 0.0054 | 0.105 | 0.0020 | 0.42 |
| O | 0.060 | 0.43 | 1.91 | 0.012 | 0.0028 | 1.960 | 0.0077 | 0.096 | 0.0013 | 1.15 |
| P | 0.043 | 0.75 | 1.83 | 0.028 | 0.0033 | 0.054 | 0.0049 | 0.135 | 0.0014 | 0.25 |
| Q | 0.082 | 0.75 | 1.45 | 0.030 | 0.0008 | 0.048 | 0.0038 | 0.113 | 0.0015 | — |
| R | 0.070 | 1.10 | 1.86 | 0.019 | 0.0020 | 0.081 | 0.0027 | 0.085 | 0.0016 | 0.26 |
| S | 0.062 | 0.68 | 1.89 | 0.009 | 0.0012 | 0.044 | 0.0041 | 0.121 | 0.0016 | 0.48 |
| T | 0.120 | 1.25 | 1.98 | 0.009 | 0.0009 | 0.079 | 0.0039 | 0.053 | 0.0018 | 0.39 |
| U | 0.131 | 0.72 | 1.93 | 0.009 | 0.0006 | 0.038 | 0.0064 | 0.042 | 0.0017 | 0.21 |
| V | 0.095 | 1.89 | 1.77 | 0.005 | 0.0011 | 0.018 | 0.0082 | 0.081 | 0.0015 | 0.25 |
| W | 0.092 | 0.55 | 1.67 | 0.027 | 0.0017 | 0.085 | 0.0021 | 0.107 | 0.0011 | 0.15 |
| a | 0.211 | 1.10 | 1.99 | 0.018 | 0.0006 | 0.045 | 0.0031 | 0.050 | 0.0021 | 0.19 |
| b | 0.076 | 2.45 | 1.35 | 0.018 | 0.0016 | 0.053 | 0.0048 | 0.114 | 0.0019 | 0.27 |
| c | 0.065 | 0.55 | 3.35 | 0.017 | 0.0020 | 0.057 | 0.0041 | 0.081 | 0.0006 | 0.36 |
| d | 0.065 | 0.55 | 2.29 | 0.017 | 0.0020 | 0.057 | 0.0041 | 0.210 | 0.0006 | 0.36 |
| e | 0.041 | 0.53 | 1.30 | 0.008 | 0.0022 | 0.045 | 0.0031 | 0.051 | 0.0011 | 2.71 |
| f | 0.081 | 0.57 | 1.42 | 0.007 | 0.0008 | 0.048 | 0.0152 | 0.112 | 0.0015 | 0.24 |
| g | 0.074 | 1.05 | 2.18 | 0.150 | 0.0009 | 0.039 | 0.0038 | 0.091 | 0.0017 | 0.48 |

| | Component composition (% by mass) | | | | | | | | |
|---|---|---|---|---|---|---|---|---|---|
| Steel | Mo | Nb | V | Cu | Ni | Sb | Ca | REM | Mg |
| A | — | — | — | — | — | — | — | — | — |
| B | — | — | — | — | — | — | — | — | — |
| C | — | — | — | — | — | — | — | — | — |
| D | — | — | — | — | — | — | — | — | — |
| E | — | — | — | — | — | — | — | — | — |
| F | — | — | — | — | — | — | — | — | — |
| G | — | — | — | — | — | — | — | — | — |
| H | — | 0.020 | — | — | — | — | — | — | — |
| I | — | 0.058 | — | — | — | — | — | — | — |
| J | — | 0.025 | — | — | — | — | — | — | — |
| K | 0.18 | — | — | — | — | — | — | — | — |
| L | 0.48 | — | — | — | — | — | — | — | — |
| M | — | — | 0.18 | — | — | — | — | — | — |
| N | — | — | — | — | — | — | — | — | — |
| O | — | — | — | — | — | — | — | — | — |
| P | 0.25 | — | — | — | — | — | — | — | — |
| Q | — | — | 0.47 | — | — | — | — | — | — |
| R | — | — | — | 0.20 | 0.10 | — | — | — | — |
| S | — | — | — | — | — | 0.015 | — | — | — |
| T | — | — | — | — | — | — | 0.0032 | — | — |
| U | — | — | — | — | — | — | — | 0.0035 | 0.0020 |
| V | — | — | — | — | — | — | — | — | — |
| W | — | — | — | — | — | — | — | — | — |
| a | — | — | — | — | — | — | — | — | — |
| b | — | — | — | — | — | — | — | — | — |
| c | — | — | — | — | — | — | — | — | — |
| d | — | — | — | — | — | — | — | — | — |
| e | — | — | — | — | — | — | — | — | — |
| f | — | — | — | — | — | — | — | — | — |
| g | — | — | — | — | — | — | — | — | — |

Note:

Underlined values are outside the range of the present invention.

TABLE 2

| Hot-rolled steel sheet No. | Steel | Slab heating temperature (° C.) | Impact pressure of descaling (MPa) | Finish rolling: Total rolling reduction at RC temperature or higher (%) | Finish rolling: Total rolling reduction at lower than RC temperature (%) | Finish rolling: Finishing temperature (° C.) | Cooling: Cooling start time (s) (*1) | Cooling: Average cooling rate (° C./s) (*2) | Cooling: Cooling stop temperature (° C.) |
|---|---|---|---|---|---|---|---|---|---|
| 1 | A | 1210 | 3.5 | 91.5 | 12.6 | 950 | 0.5 | 65 | 455 |
| 2 | A | 1240 | 4.2 | 91.7 | 0.0 | 1020 | 1.5 | 50 | 470 |
| 3 | A | 1220 | 6.5 | 77.8 | 49.9 | 930 | 1.5 | 35 | 515 |
| 4 | A | 1170 | 3.8 | 87.0 | 48.0 | 895 | 0.5 | 80 | 425 |
| 5 | B | 1200 | 4.7 | 90.8 | 12.4 | 950 | 0.5 | 45 | 570 |
| 6 | B | 1240 | 4.6 | 92.5 | 0.0 | 970 | 1.0 | 60 | 520 |
| 7 | B | 1220 | 5.5 | 87.1 | 13.9 | 935 | 1.0 | 35 | 500 |
| 8 | B | 1200 | 6.1 | 91.3 | 30.3 | 920 | 1.0 | 100 | 470 |
| 9 | B | 1180 | 3.8 | 85.6 | 30.6 | 910 | 0.5 | 45 | 540 |
| 10 | B | 1220 | 4.9 | 91.4 | 0.0 | 965 | 1.0 | 40 | 620 |
| 11 | C | 1250 | 10.1 | 88.5 | 35.4 | 890 | 1.5 | 50 | 500 |
| 12 | D | 1180 | 5.5 | 79.0 | 61.6 | 895 | 0.5 | 45 | 560 |
| 13 | D | 1170 | 6.2 | 65.0 | 83.6 | 880 | 1.0 | 55 | 520 |
| 14 | E | 1180 | 7.7 | 90.5 | 17.1 | 925 | 1.5 | 50 | 510 |
| 15 | F | 1160 | 5.3 | 65.2 | 75.5 | 865 | 0.5 | 45 | 520 |
| 16 | F | 1260 | 4.8 | 91.7 | 0.0 | 1060 | 1.5 | 45 | 490 |
| 17 | G | 1220 | 6.5 | 91.4 | 0.0 | 980 | 0.5 | 45 | 540 |
| 18 | G | 1200 | 4.4 | 88.9 | 40.8 | 920 | 1.0 | 60 | 490 |
| 19 | H | 1220 | 4.7 | 71.0 | 65.5 | 930 | 0.5 | 35 | 475 |
| 20 | H | 1200 | 4.6 | 42.5 | 76.8 | 940 | 2.0 | 30 | 540 |
| 21 | I | 1250 | 5.4 | 87.1 | 37.6 | 985 | 1.0 | 45 | 560 |
| 22 | J | 1230 | 3.5 | 57.0 | 76.0 | 920 | 1.5 | 40 | 490 |
| 23 | J | 1250 | 1.6 | 86.4 | 37.3 | 955 | 1.5 | 45 | 470 |
| 24 | K | 1210 | 4.1 | 67.5 | 75.8 | 900 | 0.5 | 50 | 500 |
| 25 | K | 1200 | 4.3 | 58.5 | 76.6 | 850 | 1.5 | 45 | 520 |
| 26 | L | 1250 | 3.2 | 88.2 | 38.8 | 905 | 0.5 | 60 | 545 |
| 27 | M | 1220 | 7.7 | 88.6 | 27.3 | 935 | 1.5 | 40 | 570 |
| 28 | M | 1230 | 6.5 | 88.5 | 13.0 | 955 | 3.0 | 40 | 530 |
| 29 | N | 1230 | 3.6 | 89.5 | 18.8 | 910 | 1.5 | 45 | 490 |
| 30 | O | 1220 | 5.7 | 89.2 | 31.2 | 930 | 0.5 | 60 | 530 |
| 31 | P | 1160 | 5.5 | 88.3 | 31.1 | 960 | 2.0 | 45 | 555 |
| 32 | Q | 1220 | 3.6 | 75.4 | 68.9 | 960 | 1.5 | 55 | 485 |
| 33 | R | 1170 | 5.5 | 91.4 | 0.0 | 965 | 1.0 | 40 | 510 |
| 34 | S | 1240 | 3.8 | 88.2 | 22.5 | 930 | 1.5 | 35 | 470 |
| 35 | T | 1170 | 6.8 | 89.1 | 26.1 | 900 | 0.5 | 50 | 500 |
| 36 | U | 1220 | 4.2 | 86.1 | 12.8 | 895 | 1.5 | 40 | 540 |
| 37 | V | 1190 | 11.0 | 88.3 | 27.1 | 895 | 0.5 | 45 | 585 |
| 38 | V | 1210 | 10.5 | 70.5 | 57.6 | 890 | 1.5 | 20 | 510 |
| 39 | W | 1230 | 3.3 | 88.5 | 25.8 | 905 | 2.0 | 45 | 485 |
| 40 | a | 1200 | 4.5 | 90.1 | 18.6 | 920 | 2.0 | 45 | 540 |
| 41 | b | 1220 | 10.3 | 89.5 | 21.1 | 910 | 1.0 | 40 | 550 |
| 42 | c | 1200 | 4.5 | 90.2 | 13.0 | 925 | 2.0 | 45 | 540 |
| 43 | d | 1220 | 3.5 | 75.7 | 63.8 | 950 | 0.5 | 40 | 490 |
| 44 | e | 1200 | 11.1 | 86.5 | 45.0 | 890 | 0.5 | 50 | 495 |
| 45 | f | 1220 | Occurrence of fracture during hot rolling | | | | | | |
| 46 | g | 1240 | | | | | | | |

| Hot-rolled steel sheet No. | Average cooling rate to (Ms − 100° C.) after coiling (° C./min) (*3) | Presence or absence of coating (*4): Presence or absence of coating (*4) | Presence or absence of coating (*4): Presence or absence of alloying (*5) | Sheet thickness (mm) | RC (° C.) (*6) | Ms (° C.) (*7) | Remarks |
|---|---|---|---|---|---|---|---|
| 1 | 0.31 | ○ | ○ | 2.6 | 955 | 447 | Example |
| 2 | 0.35 | — | — | 2.9 | 955 | 447 | Example |
| 3 | 0.48 | — | — | 4.0 | 955 | 447 | Example |
| 4 | 0.42 | — | — | 2.3 | 955 | 447 | Comparative example |
| 5 | 0.62 | — | — | 2.9 | 965 | 461 | Example |
| 6 | 0.21 | — | — | 2.6 | 965 | 461 | Example |
| 7 | 0.35 | — | — | 4.0 | 965 | 461 | Example |
| 8 | 0.65 | ○ | ○ | 2.0 | 965 | 461 | Example |
| 9 | 0.14 | — | — | 3.6 | 965 | 461 | Comparative example |
| 10 | 0.76 | — | — | 2.9 | 965 | 461 | Comparative example |

TABLE 2-continued

| | | | | | | | |
|---|---|---|---|---|---|---|---|
| 11 | 0.78 | — | — | 2.6 | 923 | 455 | Example |
| 12 | 2.31 | — | — | 2.9 | 968 | 456 | Example |
| 13 | 0.49 | — | — | 2.3 | 968 | 456 | Comparative example |
| 14 | 0.29 | — | — | 2.6 | 945 | 436 | Example |
| 15 | 0.78 | — | — | 2.9 | 953 | 436 | Example |
| 16 | 0.64 | — | — | 2.9 | 953 | 436 | Comparative example |
| 17 | 0.92 | — | — | 2.9 | 961 | 453 | Example |
| 18 | 1.67 | ○ | ○ | 2.3 | 961 | 453 | Example |
| 19 | 0.29 | — | — | 3.6 | 993 | 462 | Example |
| 20 | 0.38 | — | — | 4.0 | 993 | 462 | Comparative example |
| 21 | 0.89 | — | — | 2.9 | 1041 | 459 | Example |
| 22 | 0.51 | — | — | 3.2 | 1009 | 449 | Example |
| 23 | 0.47 | — | — | 2.9 | 1009 | 449 | Comparative example |
| 24 | 0.65 | ○ | — | 2.6 | 974 | 468 | Example |
| 25 | 0.65 | — | — | 3.2 | 974 | 468 | Comparative example |
| 26 | 0.34 | — | — | 2.6 | 970 | 473 | Example |
| 27 | 1.23 | — | — | 2.9 | 965 | 482 | Example |
| 28 | 0.75 | — | — | 3.2 | 965 | 482 | Comparative example |
| 29 | 0.39 | ○ | ○ | 2.9 | 965 | 454 | Example |
| 30 | 0.77 | — | — | 2.6 | 961 | 450 | Example |
| 31 | 0.42 | — | — | 2.9 | 990 | 471 | Example |
| 32 | 0.35 | — | — | 2.6 | 1030 | 474 | Example |
| 33 | 0.55 | — | — | 2.9 | 946 | 460 | Example |
| 34 | 0.24 | — | — | 3.2 | 973 | 461 | Example |
| 35 | 0.36 | — | — | 2.9 | 932 | 432 | Example |
| 36 | 0.23 | — | — | 4.0 | 923 | 432 | Example |
| 37 | 0.69 | — | — | 2.9 | 945 | 453 | Example |
| 38 | 0.42 | — | — | 4.0 | 945 | 453 | Comparative example |
| 39 | 0.38 | — | — | 2.9 | 958 | 460 | Example |
| 40 | 0.53 | — | — | 2.9 | 939 | 392 | Comparative example |
| 41 | 0.63 | — | — | 2.9 | 964 | 476 | Comparative example |
| 42 | 0.72 | — | — | 2.9 | 954 | 414 | Comparative example |
| 43 | 0.56 | — | — | 2.9 | 1033 | 449 | Comparative example |
| 44 | 0.35 | — | — | 2.6 | 936 | 453 | Comparative example |
| 45 | Occurrence of fracture during hot rolling | | | | 962 | 472 | Comparative example |
| 46 | | | | | 957 | 446 | Comparative example |

(*1) Time from the end of finish rolling to the start of cooling (forced cooling).

(*2) Average cooling rate from the finishing temperature to the coiling temperature (cooling stop temperature).

(*3) Average cooling rate from the coiling temperature (cooling stop temperature) to (Ms − 100° C.).

(*4) Whether to perform coating treatment. ○: yes, —: no (*5) Whether to perform alloying after coating treatment. ○: yes, —: no (*6) RC (° C.) = 850 + 100 × C + 100 × N + 10 × Mn + 700 × Ti + 5000 × B + 10 × Cr + 50 × Mo + 2000 × Nb + 150 × V . . . formula (1) Each element symbol in formula (1) indicates the element content (% by mass) of steel and is calculated as 0 when the element is not contained.

(*7) Ms (° C.) = 561 − 474 × C − 33 × Mn − 17 × Ni − 21 × Mo . . . formula (2) Each element symbol in formula (2) indicates the element content (% by mass) of steel and is calculated as 0 when the element is not contained.

Note:

Underlined values are outside the range of the present invention.

TABLE 3

| Hot-rolled steel sheet No. | Steel | Microstructure of hot-rolled steel sheet: Area percentage of upper bainite phase (%) | Area percentage of lower bainite phase and/or tempered martensite phase (%) | Area percentage of martensite phase (%) | Area percentage of secondary phase (%) (*1) | Area percentage of retained γ phase (%) | Area percentage of pearlite phase (%) | Area percentage of ferrite phase (%) | Area percentage of retained γ phase + pearlite phase + ferrite phase (%) | Average grain size of upper bainite phase (%) | Number density of grains of secondary phase having equivalent circular diameter of 0.5 μm (grains/mm$^2$) |
|---|---|---|---|---|---|---|---|---|---|---|---|
| 1 | A | 95.4 | 0.0 | 3.2 | 3.2 | 1.4 | 0.0 | 0.0 | 1.4 | 7.9 | 20083 |
| 2 | A | 94.5 | 0.0 | 4.6 | 4.6 | 0.9 | 0.0 | 0.0 | 0.9 | 10.5 | 22583 |
| 3 | A | 93.7 | 3.0 | 2.7 | 5.7 | 0.6 | 0.0 | 0.0 | 0.6 | 7.1 | 47066 |
| 4 | A | 98.1 | 0.0 | 0.0 | 0.0 | 1.9 | 0.0 | 0.0 | 1.9 | 6.9 | 0 |
| 5 | B | 84.2 | 9.4 | 5.1 | 14.5 | 0.0 | 1.3 | 0.0 | 1.3 | 7.5 | 94638 |
| 6 | B | 88.4 | 4.7 | 4.5 | 9.2 | 0.2 | 2.2 | 0.0 | 2.4 | 8.4 | 49056 |
| 7 | B | 88.6 | 3.9 | 6.3 | 10.2 | 0.4 | 0.8 | 0.0 | 1.2 | 7.9 | 67024 |
| 8 | B | 94.6 | 0.0 | 4.5 | 4.5 | 0.9 | 0.0 | 0.0 | 0.9 | 7.3 | 35082 |
| 9 | B | 94.9 | 1.3 | 1.0 | 2.3 | 0.0 | 2.8 | 0.0 | 2.8 | 9.3 | 17663 |
| 10 | B | 3.5 | 0.0 | 2.8 | 2.8 | 0.0 | 3.2 | 90.5 | 93.7 | 11.5 | 14811 |
| 11 | C | 83.3 | 6.4 | 9.9 | 16.3 | 0.4 | 0.0 | 0.0 | 0.4 | 7.5 | 98788 |
| 12 | D | 84.0 | 9.3 | 5.9 | 15.2 | 0.0 | 0.8 | 0.0 | 0.8 | 8.4 | 86857 |
| 13 | D | 87.1 | 2.5 | 9.8 | 12.3 | 0.6 | 0.0 | 0.0 | 0.6 | 6.2 | 182947 |
| 14 | E | 78.4 | 6.5 | 14.7 | 21.2 | 0.4 | 0.0 | 0.0 | 0.4 | 7.9 | 128485 |
| 15 | F | 75.5 | 6.3 | 18.2 | 24.5 | 0.0 | 0.0 | 0.0 | 0.0 | 6.5 | 138028 |
| 16 | F | 76.9 | 7.5 | 15.6 | 23.1 | 0.0 | 0.0 | 0.0 | 0.0 | 12.9 | 111666 |
| 17 | G | 87.2 | 6.9 | 5.2 | 12.1 | 0.0 | 0.7 | 0.0 | 0.7 | 7.8 | 67222 |
| 18 | G | 90.6 | 2.9 | 5.6 | 8.5 | 0.9 | 0.0 | 0.0 | 0.9 | 7.1 | 65385 |
| 19 | H | 93.8 | 0.0 | 5.1 | 5.1 | 1.1 | 0.0 | 0.0 | 1.1 | 7.5 | 56541 |
| 20 | H | 85.4 | 8.5 | 6.1 | 14.6 | 0.0 | 0.0 | 0.0 | 0.0 | 12.1 | 53091 |
| 21 | I | 85.5 | 4.4 | 9.4 | 13.8 | 0.0 | 0.7 | 0.0 | 0.7 | 7.6 | 131429 |
| 22 | J | 91.3 | 3.1 | 4.8 | 7.9 | 0.8 | 0.0 | 0.0 | 0.8 | 7.4 | 91577 |
| 23 | J | 93.1 | 0.0 | 5.7 | 5.7 | 1.2 | 0.0 | 0.0 | 1.2 | 8.2 | 55740 |
| 24 | K | 90.2 | 2.6 | 6.7 | 9.3 | 0.5 | 0.0 | 0.0 | 0.5 | 6.8 | 92971 |
| 25 | K | 88.5 | 2.2 | 9.0 | 11.2 | 0.3 | 0.0 | 0.0 | 0.3 | 6.4 | 186667 |
| 26 | L | 83.2 | 5.1 | 11.7 | 16.8 | 0.0 | 0.0 | 0.0 | 0.0 | 8.1 | 135376 |
| 27 | M | 81.0 | 8.4 | 9.8 | 18.2 | 0.0 | 0.8 | 0.0 | 0.8 | 7.9 | 107059 |
| 28 | M | 87.4 | 6.5 | 6.1 | 12.6 | 0.0 | 0.0 | 0.0 | 0.0 | 12.4 | 92672 |
| 29 | N | 88.2 | 3.7 | 7.5 | 11.2 | 0.6 | 0.0 | 0.0 | 0.6 | 8.1 | 77280 |
| 30 | O | 83.7 | 4.9 | 11.4 | 16.3 | 0.0 | 0.0 | 0.0 | 0.0 | 8.8 | 122730 |
| 31 | P | 87.1 | 6.4 | 6.2 | 12.6 | 0.0 | 0.3 | 0.0 | 0.3 | 9.0 | 105546 |
| 32 | Q | 94.2 | 0.0 | 4.7 | 4.7 | 1.1 | 0.0 | 0.0 | 1.1 | 7.3 | 93412 |
| 33 | R | 93.3 | 3.0 | 3.3 | 6.3 | 0.4 | 0.0 | 0.0 | 0.4 | 8.5 | 31559 |
| 34 | S | 94.8 | 0.0 | 4.3 | 4.3 | 0.9 | 0.0 | 0.0 | 0.9 | 7.7 | 32013 |
| 35 | T | 86.4 | 6.7 | 6.6 | 13.3 | 0.3 | 0.0 | 0.0 | 0.3 | 6.8 | 85690 |
| 36 | U | 82.8 | 10.2 | 6.5 | 16.7 | 0.0 | 0.5 | 0.0 | 0.5 | 7.2 | 91770 |
| 37 | V | 78.1 | 6.4 | 13.8 | 20.2 | 0.0 | 1.7 | 0.0 | 1.7 | 9.7 | 140799 |
| 38 | V | 67.9 | 0.0 | 4.5 | 4.5 | 0.3 | 0.0 | 27.3 | 27.6 | 8.7 | 36942 |
| 39 | W | 93.3 | 0.0 | 5.9 | 5.9 | 0.8 | 0.0 | 0.0 | 0.8 | 7.8 | 43634 |
| 40 | a | 70.0 | 9.8 | 18.7 | 28.5 | 0.4 | 1.1 | 0.0 | 1.5 | 7.2 | 113424 |
| 41 | b | 84.1 | 7.9 | 6.9 | 14.8 | 1.1 | 0.0 | 0.0 | 1.1 | 8.2 | 107030 |
| 42 | c | 72.2 | 7.5 | 19.7 | 27.2 | 0.6 | 0.0 | 0.0 | 0.6 | 8.5 | 131911 |
| 43 | d | 90.6 | 1.2 | 7.0 | 8.2 | 1.2 | 0.0 | 0.0 | 1.2 | 6.2 | 175861 |
| 44 | e | 91.7 | 2.7 | 4.8 | 7.5 | 0.8 | 0.0 | 0.0 | 0.8 | 7.1 | 54866 |
| 45 | f | Occurrence of fracture during hot rolling | | | | | | | | | |
| 46 | g | | | | | | | | | | |

| Hot-rolled steel sheet No. | Surface of hot-rolled steel sheet Arithmetic mean roughness Ra (μm) | Mechanical properties of hot-rolled steel sheet: Yield point YP (MPa) | Tensile strength TS (MPa) | Yield ratio YR (%) | Total elongation El (%) | Hole expansion ratio λ (%) | Limit V-bending R/t | vTrs (° C.) | Remarks |
|---|---|---|---|---|---|---|---|---|---|
| 1 | 1.58 | 932 | 1014 | 91.9 | 13.3 | 81 | 0.77 | −80 | Example |
| 2 | 1.43 | 933 | 1021 | 91.4 | 13.9 | 80 | 0.69 | −70 | Example |
| 3 | 1.25 | 934 | 1027 | 90.9 | 14.9 | 72 | 0.63 | −70 | Example |
| 4 | 1.52 | 1012 | 1065 | 95.0 | 10.8 | 96 | 0.43 | −100 | Comparative example |
| 5 | 1.60 | 842 | 997 | 84.5 | 15.9 | 62 | 1.03 | −50 | Example |
| 6 | 1.59 | 909 | 1035 | 87.8 | 14.2 | 71 | 0.96 | −60 | Example |
| 7 | 1.49 | 913 | 1042 | 87.6 | 15.5 | 66 | 0.75 | −60 | Example |
| 8 | 1.41 | 946 | 1045 | 90.5 | 12.5 | 75 | 0.50 | −80 | Example |
| 9 | 1.79 | 942 | 1019 | 92.4 | 13.9 | 82 | 0.83 | −70 | Comparative example |

TABLE 3-continued

| | | | | | | | | | |
|---|---|---|---|---|---|---|---|---|---|
| 10 | 1.58 | 792 | 862 | 91.9 | 15.9 | 91 | 0.34 | −40 | Comparative example |
| 11 | 1.95 | 964 | 1153 | 83.6 | 13.6 | 57 | 1.15 | −50 | Example |
| 12 | 1.82 | 863 | 1027 | 84.0 | 15.5 | 62 | 0.86 | −60 | Example |
| 13 | 1.72 | 909 | 1052 | 86.4 | 14.1 | 43 | 0.87 | −80 | Comparative example |
| 14 | 1.78 | 978 | 1220 | 80.2 | 13.3 | 50 | 1.15 | −40 | Example |
| 15 | 1.28 | 875 | 1124 | 77.8 | 15.1 | 51 | 0.52 | −40 | Example |
| 16 | 1.34 | 904 | 1147 | 78.8 | 14.7 | 55 | 0.69 | 20 | Comparative example |
| 17 | 1.49 | 885 | 1027 | 86.2 | 15.1 | 67 | 0.69 | −50 | Example |
| 18 | 1.62 | 939 | 1059 | 88.7 | 13.5 | 66 | 0.87 | −60 | Example |
| 19 | 1.67 | 994 | 1087 | 91.4 | 13.7 | 67 | 0.83 | −80 | Example |
| 20 | 1.68 | 907 | 1069 | 84.8 | 15.8 | 69 | 0.88 | −20 | Comparative example |
| 21 | 1.30 | 857 | 1006 | 85.2 | 15.6 | 55 | 0.52 | −80 | Example |
| 22 | 1.12 | 972 | 1086 | 89.5 | 13.9 | 60 | 0.31 | −90 | Example |
| 23 | 2.54 | 997 | 1095 | 91.1 | 13.1 | 67 | 1.38 | −70 | Comparative example |
| 24 | 1.59 | 950 | 1074 | 88.5 | 13.7 | 60 | 0.77 | −90 | Example |
| 25 | 1.55 | 927 | 1063 | 87.2 | 14.7 | 41 | 0.63 | −90 | Comparative example |
| 26 | 0.94 | 867 | 1042 | 83.2 | 15.1 | 53 | 0.38 | −60 | Example |
| 27 | 1.37 | 847 | 1033 | 82.0 | 15.7 | 58 | 0.52 | −50 | Example |
| 28 | 1.49 | 901 | 1045 | 86.2 | 15.2 | 61 | 0.63 | 0 | Comparative example |
| 29 | 1.26 | 943 | 1082 | 87.2 | 14.2 | 63 | 0.52 | −60 | Example |
| 30 | 1.50 | 928 | 1110 | 83.6 | 14.1 | 54 | 0.58 | −50 | Example |
| 31 | 1.17 | 916 | 1064 | 86.1 | 14.6 | 58 | 0.34 | −60 | Example |
| 32 | 1.19 | 938 | 1023 | 91.7 | 13.6 | 61 | 0.96 | −80 | Example |
| 33 | 1.63 | 931 | 1028 | 90.6 | 14.1 | 76 | 0.86 | −80 | Example |
| 34 | 1.54 | 1001 | 1090 | 91.8 | 13.2 | 74 | 0.78 | −70 | Example |
| 35 | 1.74 | 968 | 1129 | 85.7 | 13.9 | 60 | 0.86· | −60 | Example |
| 36 | 1.26 | 862 | 1036 | 83.2 | 16.6 | 61 | 0.50 | −50 | Example |
| 37 | 1.86 | 882 | 1099 | 80.3 | 15.0 | 51 | 1.03 | −40 | Example |
| 38 | 1.90 | 850 | 962 | 88.4 | 15.7 | 77 | 1.13 | −50 | Comparative example |
| 39 | 1.07 | 944 | 1039 | 90.9 | 13.9 | 72 | 0.34 | −70 | Example |
| 40 | 1.73 | 961 | 1287 | 74.7 | 13.5 | 51 | 1.03 | 40 | Comparative example |
| 41 | 2.46 | 967 | 1143 | 84.6 | 13.9 | 56 | 1.38 | −50 | Comparative example |
| 42 | 1.12 | 888 | 1169 | 76.0 | 14.7 | 51 | 0.86 | 40 | Comparative example |
| 43 | 1.27 | 987 | 1106 | 89.2 | 13.4 | 45 | 1.03 | −50 | Comparative example |
| 44 | 2.10 | 1004 | 1119 | 89.7 | 12.9 | 67 | 1.54 | −40 | Comparative example |
| 45 | Occurrence of fracture during hot rolling | | | | | | | | Comparative example |
| 46 | | | | | | | | | Comparative example |

(*1) Area percentage (%) of secondary phase = (area percentage (%) of lower bainite phase and/or tempered martensite phase) + area percentage (%) of martensite phase
Note:
Underlined values are outside the range of the present invention.

Table 3 indicates that in examples, the high-strength hot-rolled steel sheets having good press formability, good low-temperature toughness, and a tensile strength, TS, of 980 MPa or more are obtained. In contrast, in comparative examples, which are outside the range of the present invention, one or more of the strength, the press formability, and the low-temperature toughness cannot satisfy the foregoing target performance levels.

The invention claimed is:

1. A high-strength hot-rolled steel sheet having a tensile strength, TS, of 980 MPa or more, comprising a component composition containing, by mass, C: 0.04% or more and 0.15% or less, Si: 0.4% or more and 2.0% or less, Mn: 1.0% or more and 3.0% or less, P: 0.100% or less (including 0%), S: 0.0100% or less (including 0%), Al: 0.01% or more and 2.00% or less, N: 0.010% or less (including 0%), Ti: 0.03% or more and 0.15% or less, B: 0.0005% or more and 0.0050% or less, and one or two or more selected from Cr: 0.10% or more and 2.50% or less, Mo: 0.05% or more and 0.50% or less, Nb: 0.005% or more and 0.060% or less, and V: 0.05% or more and 0.50% or less, the balance being Fe and incidental impurities; and a microstructure containing 75.0% or more by area and less than 97.0% by area of a primary phase composed of an upper bainite phase, the primary phase having an average grain size of 12.0 μm or less, and more than 3.0% by area and 25.0% or less by area of a secondary phase that is a structure composed of one or two of a lower bainite phase and/or a tempered martensite phase, and a martensite phase, wherein the number density of grains of the secondary phase having an equivalent circular diameter of 0.5 μm or more is 150,000 grains/mm$^2$ or less, wherein the steel sheet has an arithmetic mean surface roughness (Ra) of 2.00 μm or less, and wherein the number density of grains of the secondary phase having an equivalent circular diameter of 0.5 μm or more is 150,000 grains/mm$^2$ or less and more than 1000 grains/mm$^2$.

2. The high-strength hot-rolled steel sheet according to claim 1, wherein the steel sheet has a ductile-to-brittle fracture transition temperature (vTrs) is −40° C. or lower, as measured in accordance with JIS Z 2242.

3. The high-strength hot-rolled steel sheet according to claim 1, wherein the steel sheet has a yield ratio of 92.0% or less.

4. The high-strength hot-rolled steel sheet according to claim 1, wherein the microstructure consists essentially of 75.0% or more by area and less than 97.0% by area of a primary phase composed of an upper bainite phase, the primary phase having an average grain size of 12.0 μm or less, more than 3.0% by area and 25.0% or less by area of a secondary phase that is a structure composed of one or two of a lower bainite phase and/or a tempered martensite phase, and a balance of the microstructure being a total area percentage of a retained austenite phase, a pearlite phase, and a ferrite phase of 0% to less than 3.0%.

5. The high-strength hot-rolled steel sheet according to claim 1, further comprising a coated layer on a surface of the steel sheet.

6. The high-strength hot-rolled steel sheet according to claim 1, wherein the component composition further contains, by mass, one or two selected from the group consisting of Group A, Group B, and Group C:

Group A; at least one selected from the group consisting of:

Cu: 0.01% or more and 0.50% or less, and

Ni: 0.01% or more and 0.50% or less,

Group B:

Sb: 0.0002% or more and 0.0200% or less, and

Group C: at least one selected from the group consisting of:

Ca: 0.0002% or more and 0.0100% or less,

Mg; 0.0002% or more and 0.0100% or less, and

REM: 0.0002% or more and 0.0100% or less.

7. The high-strength hot-rolled steel sheet according to claim 6, further comprising a coated layer on a surface of the steel sheet.

8. A method for producing the high-strength hot-rolled steel sheet having a tensile strength, TS, of 80 MPa or more according to claim 6, the method comprising:

heating a steel to 1,150° C. or higher;

then performing hot rolling including, after performing rough rolling, performing descaling with high-pressure water at an impact pressure of 3.0 MPa or more before finish rolling, and performing the finish rolling, wherein letting an RC temperature be defined by formula (1), a total rolling reduction is 50% or more at the RC temperature or higher and then 80% or less at lower than the RC temperature, and a finishing temperature is (RC−100° C.) 100° C.) or higher and (RC+100° C.) or lower;

then starting cooling within 2.0 s after completion of the finish rolling, wherein letting an Ms temperature be defined by formula (2), the cooling is performed to a cooling stop temperature of higher than the Ms temperature and 600° C. or lower at an average cooling rate of 30° C./s or more;

performing coiling at the cooling stop temperature; and then cooling a steel sheet to (Ms−100° C.) at an average cooling rate of 0.20° C./min or more, $$RC\ (^\circ C.)=850+100\times C+100\times N+10\times Mn+700\times Ti+5,000\times B+10\times Cr+50\times Mo+2,000\times Nb+150\times V \quad \text{formula (1)}$$

$$Ms\ (^\circ C.)=561-474\times C-33\times Mn-17\times Ni-21\times Mo \quad \text{formula (2)}$$

where each element symbol in formulae (1) and (2) indicates the element content (% by mass) of the steel, and when an element is not contained, the element symbol in the formula is calculated as 0.

9. The method for producing the high-strength hot-rolled steel sheet according to claim 8, further comprising subjecting a surface of the steel sheet to coating treatment.

10. A method for producing the high-strength hot-rolled steel sheet having a tensile strength, TS, of 980 MPa or more according to claim 1, the method comprising:

heating a steel to 1,150° C. or higher;

then performing hot rolling including, after performing rough rolling, performing descaling with high-pressure at an impact pressure of 3.0 MPa or more before finish rolling, and performing the finish rolling, wherein letting an RC temperature be defined by formula (1), a total rolling reduction is 50% or more at the RC temperature or higher and then 80% or less at lower than the RC temperature, and a finishing temperature is (RC−100° C.) or higher and (RC+100° C.) or lower;

then starting cooling within 2.0 s after completion of the finish rolling, wherein letting an Ms temperature be defined formula (2), the cooling is performed to a cooling stop temperature of higher than the Ms temperature and 600° C. or lower at an average cooling rate of 30° C./s or more;

performing coiling at the cooling stop temperature; and then cooling a steel sheet to (Ms−100° C.) at an average cooling rate of 0.20° C./min or more, $$RC\ (^\circ C.)=850+100\times C+100\times N+10\times Mn+700\times Ti+5,000\times B+10\times Cr+50\times Mo+2,000\times Nb+150\times V \quad \text{formula (1)}$$

$$Ms\ (^\circ C.)=561-474\times C-33\times Mn-17\times Ni-21\times Mo \quad \text{formula (2)}$$

where each element symbol in formulae (1) and (2) indicates the element content (% by mass) of the steel, and when an element is not contained, the element symbol in the formula is calculated as 0.

11. The method for producing the high-strength hot-rolled steel sheet according to claim 10, further comprising subjecting a surface of the steel sheet to coating treatment.

* * * * *